US010303075B2

(12) United States Patent
Tanaka et al.

(10) Patent No.: US 10,303,075 B2
(45) Date of Patent: May 28, 2019

(54) TONER

(71) Applicant: CANON KABUSHIKI KAISHA, Tokyo (JP)

(72) Inventors: Keisuke Tanaka, Yokohama (JP); Yojiro Hotta, Mishima (JP); Kazuo Terauchi, Numazu (JP); Koji Nishikawa, Susono (JP); Takaaki Furui, Tokyo (JP); Ryo Nagata, Mishima (JP); Kazuyuki Sato, Yokohama (JP); Yu Yoshida, Mishima (JP); Yusuke Kosaki, Susono (JP); Masami Fujimoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/903,241

(22) Filed: Feb. 23, 2018

(65) Prior Publication Data

US 2018/0246430 A1 Aug. 30, 2018

(30) Foreign Application Priority Data

Feb. 28, 2017 (JP) ..... 2017-036331
Jan. 18, 2018 (JP) ..... 2018-006077

(51) Int. Cl.
*G03G 9/097* (2006.01)
*G03G 9/08* (2006.01)

(52) U.S. Cl.
CPC ..... *G03G 9/09725* (2013.01); *G03G 9/0819* (2013.01); *G03G 9/0821* (2013.01); *G03G 9/0825* (2013.01); *G03G 9/0827* (2013.01); *G03G 9/09708* (2013.01); *G03G 9/09716* (2013.01)

(58) Field of Classification Search
CPC ..... G03G 9/09708; G03G 9/09725; G03G 9/0819; G03G 9/0821; G03G 9/0827
See application file for complete search history.

(56) References Cited

U.S. PATENT DOCUMENTS 4,657,838 A 4/1987 Fukumoto et al.
4,673,631 A 6/1987 Fukumoto et al.
4,710,443 A 12/1987 Tanaka et al.
4,737,432 A 4/1988 Tanaka et al.
4,839,255 A 6/1989 Hyosu et al.
4,886,725 A 12/1989 Tanaka et al.
5,071,727 A 12/1991 Ikeda et al.
5,288,579 A 2/1994 Tanaka et al.
5,306,588 A 4/1994 Tanaka et al.
5,354,637 A 10/1994 Shimamura et al.
5,356,749 A 10/1994 Hagiwara et al.
5,406,357 A 4/1995 Nakahara et al.
5,415,967 A 5/1995 Sakashita et al.
5,436,701 A 7/1995 Shimojo et al.
5,447,813 A 9/1995 Hagiwara et al.
5,508,139 A 4/1996 Tanaka et al.
5,547,796 A 8/1996 Kohtaki et al.
5,716,746 A 2/1998 Mikuriya et al.
5,759,731 A * 6/1998 Hagi ..... G03G 9/08755 430/108.6
5,968,701 A 10/1999 Onuma et al.
6,020,102 A 2/2000 Fujimoto et al.
6,120,961 A 9/2000 Tanikawa et al.
6,156,471 A 12/2000 Kobori et al.
6,203,959 B1 3/2001 Tanikawa et al.
6,235,441 B1 5/2001 Tanikawa et al.
6,528,222 B2 3/2003 Kohtaki et al.
6,541,174 B1 4/2003 Tanikawa et al.
6,586,147 B2 7/2003 Iida et al.
6,653,036 B1 11/2003 Tanikawa et al.
6,670,087 B2 12/2003 Fujikawa et al.
6,751,424 B2 6/2004 Komatsu et al.
6,808,852 B2 10/2004 Hotta et al.
6,929,894 B2 8/2005 Sugahara et al.
7,115,349 B2 10/2006 Iida et al.
7,138,213 B2 11/2006 Itakura et al.
7,144,668 B2 12/2006 Baba et al.
(Continued)

FOREIGN PATENT DOCUMENTS

EP 1 515 196 5/2015
JP 2010044113 A * 2/2010
(Continued)

OTHER PUBLICATIONS

English language machine translation of JP 2010-044113 (Feb. 2010).*
U.S. Appl. No. 15/814,818, Masao Suzuki, filed Nov. 16, 2017.
U.S. Appl. No. 15/840,404, Kosuke Fukudome, filed Dec. 13, 2017.
U.S. Appl. No. 15/843,137, Atsuhiko Ohmori, filed Dec. 15, 2017.
U.S. Appl. No. 15/889,585, Shinnosuke Koji, filed Feb. 6, 2018.
U.S. Appl. No. 15/901,220, Koji Nishikawa, filed Feb. 21, 2018.

*Primary Examiner* — Christopher D Rodee
(74) *Attorney, Agent, or Firm* — Venable LLP

(57) ABSTRACT

A toner including a toner particle and an external additive, wherein the external additive contains an inorganic fine particle A and a silica fine particle; in a surface of the toner observed using a scanning electron microscope, a number-average particle diameter of primary particle of the silica fine particle is from 5 nm to 50 nm, a number-average particle diameter of primary particle of the inorganic fine particle A is at least 10 nm and less than 60 nm, a coverage ratio X1 of the toner surface covered by the silica fine particle is from 60 area % to 95 area %, the inorganic fine particle A is a fine particle of a titanate having a Group 2 element, and a coverage ratio X2 of the toner surface covered by the inorganic fine particle A is from 5 area % to 40 area %.

9 Claims, No Drawings

(56) References Cited

U.S. PATENT DOCUMENTS 7,147,980 B2 12/2006 Itakura et al.
7,147,981 B2 12/2006 Fujikawa et al.
7,244,539 B2 7/2007 Baba et al.
7,273,686 B2 9/2007 Onuma et al.
7,288,354 B2 10/2007 Moribe et al.
7,351,509 B2 4/2008 Moribe et al.
7,393,621 B2 * 7/2008 Lee ..... G03G 9/08782 430/108.6
7,422,832 B2 9/2008 Ogawa et al.
7,455,947 B2 11/2008 Ida et al.
7,537,877 B2 5/2009 Yoshiba et al.
7,582,401 B2 9/2009 Ogawa et al.
7,629,100 B2 12/2009 Okamoto et al.
7,700,254 B2 4/2010 Moribe et al.
7,740,998 B2 6/2010 Yamazaki et al.
7,745,089 B2 6/2010 Okubo et al.
7,767,370 B2 8/2010 Ishigami et al.
7,816,063 B2 10/2010 Hashimoto et al.
7,855,042 B2 12/2010 Kobori et al.
7,897,316 B2 3/2011 Yamazaki et al.
7,906,262 B2 3/2011 Ishigami et al.
8,057,977 B2 11/2011 Moribe et al.
8,142,972 B2 3/2012 Hotta et al.
8,293,447 B2 10/2012 Yamazaki et al.
8,501,377 B2 8/2013 Takahashi et al.
8,512,925 B2 8/2013 Moribe et al.
8,927,188 B2 1/2015 Naka et al.
9,040,216 B2 5/2015 Fukudome et al.
9,046,800 B2 6/2015 Hotta et al.
9,097,998 B2 8/2015 Yamazaki et al.
9,116,448 B2 8/2015 Terauchi et al.
9,128,400 B2 9/2015 Takahashi et al.
9,134,637 B2 9/2015 Hotta et al.
9,141,012 B2 9/2015 Moribe et al.
9,158,216 B2 10/2015 Shimano et al.
9,201,323 B2 12/2015 Nishikawa et al.
9,213,251 B2 12/2015 Ohmori et al.
9,235,151 B2 1/2016 Tanaka et al.
9,239,528 B2 1/2016 Hasegawa et al.
9,250,548 B2 2/2016 Nomura et al.
9,261,804 B2 2/2016 Yamazaki et al.
9,309,349 B2 4/2016 Watanabe et al.
9,341,970 B2 5/2016 Yoshiba et al.
9,377,705 B2 6/2016 Shimano et al.
9,383,668 B2 7/2016 Noji et al.
9,429,860 B2 8/2016 Kinumatsu et al.
9,470,993 B2 10/2016 Nishikawa et al.
9,575,424 B2 2/2017 Nakagawa et al.
9,575,425 B2 2/2017 Naka et al.
9,588,450 B2 3/2017 Tsuda et al.
9,599,919 B2 3/2017 Isono et al.
9,606,462 B2 3/2017 Nomura et al.
9,658,546 B2 5/2017 Tanaka et al.
9,658,554 B2 5/2017 Kinumatsu et al.
9,715,188 B2 7/2017 Terauchi et al.
9,772,570 B2 9/2017 Tsuda et al.
9,778,583 B2 10/2017 Terauchi et al.
9,785,071 B2 10/2017 Shimano et al.
9,798,256 B2 10/2017 Kosaki et al.
9,798,262 B2 10/2017 Toyoizumi et al.
9,811,016 B2 11/2017 Aoki et al.
9,823,595 B2 11/2017 Toyoizumi et al.
9,829,814 B2 11/2017 Yoshida et al.
9,829,816 B2 11/2017 Tanaka et al.
9,829,818 B2 11/2017 Yoshiba et al.
9,835,964 B2 12/2017 Yoshida et al.
9,857,707 B2 1/2018 Tsuda et al.
9,857,711 B2 1/2018 Yoshida et al.
9,857,713 B2 1/2018 Kosaki et al.
9,869,943 B2 1/2018 Aoki et al.
9,897,932 B2 2/2018 Hotta et al.
9,904,195 B2 2/2018 Matsui et al.
2005/0209364 A1 9/2005 Yamagishi et al.
2006/0121382 A1 * 6/2006 Choi ..... G03G 9/09708 430/108.21
2009/0004582 A1 * 1/2009 Kim ..... G03G 9/0819 430/48
2009/0134356 A1 * 5/2009 Ochiai ..... G03G 9/09708 252/182.33
2010/0092884 A1 * 4/2010 Kumar ..... G03G 9/08708 430/108.11
2013/0252167 A1 9/2013 Moribe et al.
2013/0309603 A1 11/2013 Takahashi et al.
2014/0004460 A1 1/2014 Yoshiba et al.
2014/0315126 A1 * 10/2014 Magome ..... G03G 9/0825 430/108.3
2014/0377696 A1 12/2014 Hasegawa et al.
2015/0125790 A1 5/2015 Hotta et al.
2015/0220013 A1 8/2015 Nishikawa et al.
2015/0227067 A1 8/2015 Hasegawa et al.
2015/0227068 A1 * 8/2015 Sano ..... G03G 9/0835 430/108.3
2016/0139522 A1 5/2016 Yoshiba et al.
2016/0161874 A1 6/2016 Yamazaki et al.
2016/0202624 A1 7/2016 Nishikawa et al.
2017/0199475 A1 7/2017 Fukudome et al.
2017/0269491 A1 9/2017 Terui et al.
2017/0269494 A1 9/2017 Yoshida et al.
2017/0269495 A1 9/2017 Terui et al.
2017/0269496 A1 9/2017 Kubo et al.
2018/0004106 A1 1/2018 Matsui et al.
2018/0004108 A1 1/2018 Tsuda et al.
2018/0004109 A1 1/2018 Matsui et al.
2018/0074425 A1 3/2018 Mizuguchi et al.

FOREIGN PATENT DOCUMENTS

JP 2010-211245 9/2010
JP 2013-156614 8/2013
JP 5442045 3/2014
JP 2015-011131 1/2015
JP 2015-028601 2/2015
JP 2015-137208 7/2015
KR 20060062631 A * 6/2006 ..... G03G 9/09708
KR 20090000506 A * 1/2009 ..... G03G 9/0819

* cited by examiner

TONER

BACKGROUND OF THE INVENTION

Field of the Invention

The present invention relates to a toner used in image-forming methods such as electrophotographic methods and electrostatic recording methods.

Description of the Related Art

It has been necessary in recent years for the main unit of printers and copiers that use an electrophotographic system (also referred to below simply as the main unit) to accommodate greater energy conservation demands, higher process speeds, main unit downsizing, and diverse use environments, e.g., low-temperature, low-humidity environments and high-temperature, high-humidity environments.

Charge is imparted to toner by friction mainly when the toner is rubbed between the toner bearing member and a control member (also referred to below simply as a control element).

At higher process speeds and with the smaller toner bearing members associated with main unit downsizing, the number of times the toner is rubbed at this control element and between the toner bearing member and the electrostatic latent image bearing member (also referred to below simply as the developing nip) is increased. As a consequence of this, the external additive is buried and conversion occurs to a structure in which toner deterioration, e.g., toner-to-toner aggregation, is facilitated, and thus a higher level of performance is required of the toner.

In addition, greater reductions in the toner fixation temperature are critical for achieving greater energy conservation. For example, a resin having a low softening point or a crystalline material having a strong sharp-melt property is used in the binder resin for toner in order to bring about toner fixing at lower temperatures.

However, in the case of use of such a resin having a low softening point or a resin having a strong sharp-melt property and softening at a specific temperature, during the long-term repetitive use of, e.g., a printer, the external additive is buried due to the heat and external forces and toner-to-toner aggregation is then facilitated and the appearance of deterioration of the toner is facilitated.

When a toner undergoes deterioration, the appearance of fogging is facilitated, caused by a reduction in toner flowability and a reduction in the uniformity of toner charging. Reductions in the image density are also facilitated. The toner must therefore have a durability that provides a stable image output.

With regard to the diversification of use environments, on the other hand, the generation of high-quality images is being required not only in air-conditioned normal-temperature, normal-humidity environments, such as offices, but also in demanding environments such as high-temperature, high-humidity environments and low-temperature, low-humidity environments.

However, the amount of charge on the toner is prone to be insufficient in high-temperature, high-humidity environments due to the influence on the toner, for example, of the moisture in the air. In addition, burying of the external additive present at the toner surface is facilitated in high-temperature environments. As a result, toner deterioration is facilitated and the generation of image defects, i.e., the generation of fogging and reductions in image density, is facilitated.

In addition, the appearance of image defects caused by toner charge up (i.e., overcharge) is facilitated in low-temperature, low-humidity environments; for example, the appearance of image defects, i.e., the generation of fogging and reductions in toner transferability, is facilitated.

The suppression of image defects through the use of titanate fine particles containing a Group 2 element, e.g., strontium titanate, has been pursued in order to bring about stable image formation even in demanding environments, i.e., in high-temperature, high-humidity environments and low-temperature, low-humidity environments.

Japanese Patent Application Laid-open No. 2015-137208 proposes that the external addition to the toner particle of a strontium titanate particle having a controlled $SrO/TiO_2$ molar ratio brings about improved environmental characteristics and improved charging characteristics for toners.

Japanese Patent No. 5,442,045 proposes that the developing performance of a toner immediately after standing in a high-temperature, high-humidity environment be improved by controlling the fixing state on the toner surface of strontium titanate particles having a particular particle diameter and by controlling the covering state of the toner surface by silica fine particles.

Japanese Patent Application Laid-open No. 2015-28601 proposes that the developing performance in high-temperature, high-humidity environments and the transferability and cleaning performance in low-temperature, low-humidity environments are improved by the external addition to the toner particle of titanate fine particles having a Group 2 element and having a specific particle diameter and by control of the coverage ratio by silica fine particles on the toner surface and control of their burying into the toner particle.

SUMMARY OF THE INVENTION

A certain effect was obtained with the disclosure in Japanese Patent Application Laid-open No. 2015-137208, but it was insufficient with regard to inducing functionality by the strontium titanate particles on the toner surface and was inadequate for responding to the aforementioned demanding conditions for the toner, i.e., raising the speed of the main unit and downsizing the main unit.

On the other hand, in the disclosures of Japanese Patent No. 5,442,045 and Japanese Patent Application Laid-open No. 2015-28601, art is implemented, i.e., control of the external addition method and control of the state of occurrence of the external additive, to cause the strontium titanate particles to be present in a more broken-up or more disintegrated state.

As a consequence, separation charging is carried out using the strontium titanate particles as a microcarrier and, at the same time, by bringing about contact with the toner, an inhibitory effect on charge up is exhibited on the toner. The result is the occurrence of a stable image output regardless of the use environment.

However, strontium titanate particles having a large particle diameter, such as the at least 60 nm as in Japanese Patent No. 5,442,045 and Japanese Patent Application Laid-open No. 2015-28601, do not remain on the toner particle and melt-adhere to the control member. The toner itself can then melt-adhere to the control member with the melt-adhered strontium titanate particles functioning as a starting point.

This inability of the external additive to remain on the toner particle and its movement to, for example, another toner particle or a member, is referred to as migration. Image defects, i.e., the control defect described below, are produced when melt-adhesion to the control member occurs due to this strontium titanate particle migration.

In particular, in systems configured to accommodate main unit downsizing and/or higher speeds at the main unit, the number of times that the toner is rubbed at the control element and the developing nip is also large, and in addition the external additive is readily buried in the case of toner constituted of a readily softenable resin.

As a consequence, the toner also readily undergoes deterioration and stable charging is difficult to obtain. When, during this, strontium titanate particles melt-adhere to a control member, not only are there control defects, but the development of an adequate inhibitory effect on charge up is impaired and the generation of image defects, i.e., fogging, is also facilitated.

In systems configured to accommodate main unit downsizing and/or higher speeds at the main unit, strontium titanate particle migration is particularly significant and the generation of control defects and image defects, i.e., fogging, is facilitated, and thus room for improvement still remains.

The present invention provides a toner that extinguishes the problems described above.

That is, the present invention provides a toner that, even during long-term continuous use in diverse use environments, produces a stable image density and can suppress the occurrence of fogging and can suppress image defects caused by control defects.

The present invention relates to a toner including a toner particle and an external additive, wherein the external additive contains an inorganic fine particle A and a silica fine particle, in a surface of the toner observed using a scanning electron microscope, a number-average particle diameter of primary particle of the silica fine particle is from 5 nm to 50 nm, a number-average particle diameter of primary particle of the inorganic fine particle A is at least 10 nm and less than 60 nm, a coverage ratio X1 of the toner surface covered by the silica fine particle, as determined using an x-ray photoelectron spectrometer, is from 60 area % to 95 area %, the inorganic fine particle A is a fine particle of a titanate having a Group 2 element, and a coverage ratio X2 of the toner surface covered by the inorganic fine particle A, as determined using an x-ray photoelectron spectrometer, is from 5 area % to 40 area %.

Further features of the present invention will become apparent from the following description of exemplary embodiments.

DESCRIPTION OF THE EMBODIMENTS

Unless specifically indicated otherwise, the phrases at least XX and not more than YY, from XX to YY and XX to YY that give numerical value ranges indicate in the present invention numerical value ranges that include the lower limit and upper limit that are the end points.

The present invention is described in detail in the following, but this should not be construed as a limitation thereby or thereto.

The present invention is a toner that includes a toner particle and an external additive, wherein the external additive contains an inorganic fine particle A and a silica fine particle; in a surface of the toner observed using a scanning electron microscope, the number-average particle diameter (D1) of primary particle of the silica fine particle is from 5 nm to 50 nm, the number-average particle diameter (D1) of primary particle of the inorganic fine particle A is at least 10 nm and less than 60 nm, the coverage ratio X1 of the toner surface covered by the silica fine particle, as determined using an x-ray photoelectron spectrometer (ESCA), is from 60 area % to 95 area %, the inorganic fine particle A is a fine particle of a titanate having a Group 2 element, and the coverage ratio X2 of the toner surface covered by the inorganic fine particle A, as determined using an x-ray photoelectron spectrometer (ESCA), is from 5 area % to 40 area %.

The control defects will be considered first.

The external additive melt-adheres onto the toner bearing member, and the toner itself, with this melt adhesion functioning as a starting point, sticks to the toner bearing member as well. Due to the adhered toner following along on the toner bearing member during printing, differences in the toner laid-on level on the toner bearing member are produced and the charge distribution in the toner becomes nonuniform. As a result, punctiform or wave-shaped unevenness is produced in the obtained image. This phenomenon is referred to as a control defect.

External additive migration is the cause of this control defect. The easier it is for the external additive to migrate from the toner particle, the easier is the production of melt-adhesion by the external additive to the control member and the easier is the generation of the control defect caused by toner melt-adhesion that starts from this external additive melt-adhesion.

In order to cause migration from the toner particle and contact with and release from the toner, titanate fine particles having a large particle diameter have been used for the titanate fine particles heretofore used as microcarriers. In addition, for the toner described in Japanese Patent No. 5,442,045 and Japanese Patent Application Laid-open No. 2015-28601, when the particle diameter was at least 60 nm, titanate fine particles with a certain large particle diameter were caused to be present in a broken-up or disintegrated state and charge up was suppressed through a relaxation of toner charge caused by contact between the toner and the titanate fine particles.

However, titanate fine particles having a certain large particle diameter, such as a particle diameter of at least 60 nm, readily migrated from the toner particle, and this facilitated the occurrence of the control defect caused by the melt-adhesion of these titanate fine particles to the control member.

Moreover, in structures where a large number of rubbing events are applied to the toner by the control member, as when the main unit is sped up or downsized, the toner undergoes deterioration more easily and migration by these titanate fine particles to the control member is further facilitated. As a result, the inhibitory effect on charge up also became inadequate and the generation of image defects, e.g., fogging, was also facilitated.

In order to solve this problem, the present inventors investigated bringing about the generation of an inhibitory effect on charge up by coating the toner particle with titanate fine particles having a particle diameter of less than 60 nm (referred to as small-diameter titanate fine particles in the following), rather than generating the inhibitory effect on charge up using the titanate fine particles of at least 60 nm (referred to as large-diameter titanate fine particles in the following) heretofore used as microcarriers.

Specifically, investigations were carried out into the utilization of such small-diameter titanate fine particles coated on the toner particle as leak points that would release charge accumulated on the toner. That is, the thinking was that perhaps an inhibitory effect on charge up could be generated by using a small-diameter titanate fine particle as a medium-resistance particle.

However, small-diameter titanate particles, by virtue of their small diameters, are prone to aggregate with one another and it is difficult to uniformly coat them on the toner surface, and as a consequence the generation of an inhibitory effect on charge up was quite problematic.

Particularly in structures configured to accommodate main unit downsizing and/or higher speeds at the main unit, toner deterioration was also substantial and this was inadequate for obtaining an inhibitory effect on charge up.

In contrast to this, it was discovered that the problems described above could be solved by using silica fine particles having a particle diameter in a special range, by using Group 2 element-containing titanate fine particles having a particle diameter in a special range, and by controlling the coverage ratio of the toner surface by these into special ranges.

The present inventors believe the reasons for this are as follows.

First, a high toner flowability can be obtained by controlling the coverage ratio of the toner surface by the silica fine particles into the special range. By doing this, stable charging characteristics can be secured even in the absence of the microcarrier effect of the titanate fine particles.

In addition, by repeated collisions—in the process for establishing the indicated coverage ratios—of the small-diameter titanate fine particles with the silica fine particles present in large amounts on the toner surface, the small-diameter titanate fine particles are broken-up or disintegrated and coverage of the toner surface is facilitated.

It is further presumed that a breaking-up action on the small-diameter titanate fine particles occurs—due to collisions between the small-diameter titanate fine particles and silica fine particles present on the toner surface—also during use for long-term printing.

In particular, burying of the external additive occurs more easily with a toner in which the binder resin is a relatively soft resin, such as polyester resin, than with the hard toner disclosed in Japanese Patent No. 5,442,045 and Japanese Patent Application Laid-open No. 2015-28601 in which the binder resin is a styrene-acrylic resin. In the case of toner in which burying of the external additive readily occurs, the influence of the breaking-up effect on the small-diameter titanate fine particles due to the effects of collisions between the silica fine particles and small-diameter titanate fine particles is thought to be substantial.

Small-diameter titanate fine particles broken-up due to the effects of collisions are favorably coated on the toner surface without aggregation, and it is thought that as a result many leak points that release the charge on the toner are produced and a stronger inhibitory effect on charge up can then be displayed.

Moreover, due to the use of small-diameter titanate fine particles, migration to the control member, such as that seen with large-diameter titanate fine particles, is also scarce and the occurrence of the control defect caused by the melt-adhesion of titanate fine particles is also impeded.

The toner in the present disclosure contains a toner particle and an external additive, and this external additive contains an inorganic fine particle A and a silica fine particle. As necessary, the toner particle contains, for example, a binder resin, a colorant, a wax, a charge control agent, and so forth.

The coverage ratio X1 of the toner surface by the silica fine particles, as determined by x-ray photoelectron spectroscopy (ESCA), is from 60 area % to 95 area %. This coverage ratio X1 is preferably from 76 area % to 95 area %.

The coverage ratio X1 indicates the percentage occurrence of the silica fine particles on the toner surface. When the indicated range is adopted for the coverage ratio X1, toner flowability can be ensured and the charging performance can be maintained even in high-temperature, high-humidity environments. In addition, because the toner surface can be favorably coated with Group 2 element-containing titanate fine particles, an inhibitory effect on charge up and an inhibitory effect on control defects can be obtained.

The number-average particle diameter (D1) of the primary particle of the silica fine particles, in the surface of the toner observed using a scanning electron microscope, is from 5 nm to 50 nm. This number-average particle diameter (D1) is preferably from 5 nm to 20 nm.

When the indicated range is adopted for this number-average particle diameter (D1), problems produced when the number of parts of silica fine particle addition is increased can be suppressed. For example, the coverage ratio X1 is easily controlled into the aforementioned range without impairing the low-temperature fixability. The coverage ratio X1 can be controlled by adjusting the amount of addition, particle diameter, and external addition conditions for the silica fine particles and by adjusting the properties of the toner particle. The method for measuring the number-average particle diameter (D1) of the primary particle of the silica fine particles is described below.

The silica fine particle content, per 100 mass parts of the toner particle, is preferably from 1.8 mass parts to 4.5 mass parts and is more preferably from 2.0 mass parts to 3.0 mass parts.

The coverage ratio X1 and the coverage ratio X2 are readily controlled as appropriate when the indicated range is adopted for the silica fine particle content.

The inorganic fine particle A is a fine particle of a titanate having a Group 2 element.

The Group 2 element is an element (representative element) belonging to Group 2 of the Periodic Table, and the Group 2 elements include beryllium, magnesium, calcium, strontium, barium, and radium.

Among these, calcium, strontium, barium, and radium are also referred to as alkaline-earth metals. The fine particles of a titanate having a Group 2 element (Group element-containing titanate fine particles) can be exemplified by beryllium titanate fine particles, magnesium titanate fine particles, calcium titanate fine particles, strontium titanate fine particles, barium titanate fine particles, and radium titanate fine particles.

A single species of Group 2 element-containing titanate fine particle may be used as the inorganic fine particle A or a mixture of two or more species may be used.

Among the preceding, strontium titanate fine particles are preferred because they have a volume resistivity that facilitates escape of the charge on the toner and because, having a suitable hardness, they can also exhibit an abrasive effect when the toner is melt-adhered to, for example, the control member.

The coverage ratio X2 by the inorganic fine particle A of the toner surface, as determined with an x-ray photoelectron spectrometer (ESCA), is from 5 area % to 40 area %. This coverage ratio X2 is preferably from 5 area % to 25 area % and is more preferably from 5 area % to 20 area %.

The coverage ratio X2 indicates the percentage occurrence of the inorganic fine particle A on the toner surface. When the indicated range is adopted for the coverage ratio X2, the contact surfaces of the Group 2 element-containing titanate fine particles are adequately exposed and leakage of excess charge accumulated on the toner is facilitated and an inhibitory effect on charge up is exhibited.

The coverage ratio X2 can be controlled through adjustment of the amount of addition, the particle diameter, and the external addition conditions for the inorganic fine particle A and through adjustment of the properties of the toner particle.

The number-average particle diameter (D1) of the primary particle of the inorganic fine particle A, in observation of the toner surface with a scanning electron microscope, is at least 10 nm and less than 60 nm. This number-average particle diameter (D1) is preferably from 10 nm to 50 nm.

When the indicated range is adopted for this number-average particle diameter (D1), migration of the inorganic fine particle A from the toner particle is inhibited and the control defect that is initiated by melt-adhesion to the control member can be suppressed.

This number-average particle diameter (D1) can be controlled by adjusting the molar ratio for the starting materials for the inorganic fine particle A and by adjusting its production conditions.

The fixing ratio of the inorganic fine particle A to the toner particle is preferably from 40% to 100%, more preferably from 54% to 100%, and still more preferably from 59% to 100%.

When the indicated range is adopted for the fixing ratio, melt-adhesion by the toner to the control member is impeded and, because the inorganic fine particle A is firmly fixed to the toner particle, leakage of the excess charge on the toner is facilitated.

This fixing ratio can be controlled by adjusting the amount of addition, particle diameter, and external addition conditions for the inorganic fine particle A and by adjusting the properties of the toner particle.

The content of the inorganic fine particle A, per 100 mass parts of the toner particle, is preferably from 0.5 mass parts to 3.5 mass parts, more preferably from 0.5 mass parts to 2.0 mass parts, and still more preferably from 0.9 mass parts to 2.0 mass parts.

When the indicated range is adopted for the content of the inorganic fine particle A, the coverage ratio X1 and the coverage ratio X2 can be controlled with good balance therebetween.

The average circularity of the primary particle of the inorganic fine particle A is preferably from 0.700 to 0.920 and is more preferably from 0.790 to 0.920.

By adopting this range for the average circularity, a large contact area between the toner particle and the inorganic fine particle A can be generated and migration of the inorganic fine particle A from the toner particle can then be impeded and the charging performance of the toner can be even more readily controlled. As a result, during long-term endurance use, improvements in the developing performance, suppression of fogging, and control defect suppression are more readily achieved.

The average circularity of the primary particle of the inorganic fine particle A can be controlled through adjustment of the production conditions.

The inorganic fine particle A preferably has the perovskite structure.

In a test of wettability of the inorganic fine particle A relative to a methanol/water mixed solvent, the methanol concentration at a 50% transmittance of light at a wavelength of 780 nm is preferably from 60 volume % to 95 volume % and is more preferably from 65 volume % to 95 volume %.

The developing performance in high-temperature, high-humidity environments is further improved when the indicated range for the methanol concentration is adopted.

The wettability of the inorganic fine particle A versus a methanol/water mixed solvent can be controlled by adjusting the surface treatment conditions for the inorganic fine particle A.

The inorganic fine particle A will be described in detail using the example of strontium titanate fine particles.

The strontium titanate fine particles are preferably produced using a normal-pressure thermal reaction procedure, in which the reaction is run at normal pressure, rather than a hydrothermal process using a pressurized vessel.

The mineral acid deflocculation product of the hydrolyzate of a titanium compound is used as the titanium oxide source, and a water-soluble acidic compound is used as the strontium source. The method can be exemplified by running a reaction while adding an aqueous alkali solution at at least 60° C. to a mixture of the titanium oxide source and strontium source and subsequently carrying out an acid treatment.

In addition, the shape of the strontium titanate particle can also be controlled by the application of a dry mechanical treatment.

The normal-pressure thermal reaction procedure is described in the following.

The mineral acid deflocculation product of the hydrolyzate of a titanium compound may be used as the titanium oxide source.

The use is preferred of the deflocculation product provided by the deflocculation, by adjustment of the pH with hydrochloric acid to 0.8 to 1.5, of a metatitanic acid produced by the sulfate method and having an $SO_3$ content of not more than 1.0 mass % and preferably not more than 0.5 mass %. Doing this makes it possible to obtain strontium titanate fine particles having an excellent particle size distribution.

On the other hand, strontium nitrate, strontium chloride, and so forth can be used as the strontium source. An alkali hydroxide can be used as the aqueous alkali solution, whereamong an aqueous sodium hydroxide solution is preferred.

The factors that influence the particle diameter of the obtained strontium titanate fine particles in this production method are, for example, the mixing proportions for the titanium oxide source and the strontium source, the concentration of the titanium oxide source in the initial phase of the reaction, the temperature and addition rate when the aqueous alkali solution is added, and so forth. These factors can be judiciously selected in order to obtain strontium titanate fine particles having the target particle diameter and particle size distribution. In order to prevent the production of strontium carbonate during the reaction process, the admixture of carbon dioxide gas is preferably prevented, for example, by running the reaction under a nitrogen gas atmosphere.

The mixing proportion between the strontium source and the titanium oxide source at the time of the reaction, as Sr/Ti molar ratio, is preferably from 0.90 to 1.40 and is more preferably from 1.05 to 1.20.

The titanium oxide source has a low water solubility in contrast to the high water solubility of the strontium source, and as a consequence, when Sr/Ti molar ratio is less than 0.90, the reaction product will not be strontium titanate alone and unreacted titanium oxide will tend to still be present.

The concentration of the titanium oxide source at the start of the reaction, as $TiO_2$, is preferably from 0.05 mol/L to 1.300 mol/L and is more preferably from 0.080 mol/L to 1.200 mol/L.

A smaller number-average primary particle diameter for the strontium titanate fine particles can be obtained by using a higher concentration for the titanium oxide source at the start of the reaction.

With regard to the temperature during the addition of the aqueous alkali solution, a product exhibiting a better crystallinity is obtained as the temperature is raised. However, because a pressure vessel, e.g., an autoclave, is required at 100° C. and above, the range of from 60° C. to 100° C. is advantageous from a practical standpoint.

With regard to the rate of addition of the aqueous alkali solution, strontium titanate fine particles with larger particle diameters are obtained at slower rates of addition, while strontium titanate fine particles with smaller particle diameters are obtained at higher rates of addition. The rate of addition of the aqueous alkali solution, considered with reference to the starting materials charged, is preferably from 0.001 eq/h to 1.2 eq/h and is more preferably from 0.002 eq/h to 1.1 eq/h. This can be adjusted as appropriate in conformity to the particle diameter to be obtained.

The acid treatment is described in the following. When the mixing proportion between the strontium source and titanium oxide source exceeds 1.40 for Sr/Ti molar ratio, unreacted strontium source remaining after the completion of the reaction will react with the carbon dioxide gas in the air to produce impurities, such as strontium carbonate, and the particle size distribution is prone to broadening. Moreover, when impurities such as strontium carbonate remain present at the surface, due to the influence of the impurities, the execution of a uniform coating by the surface treatment agent is impaired when a surface treatment is performed in order to impart hydrophobicity. Thus, once the aqueous alkali solution has been added, an acid treatment is preferably carried out in order to eliminate the unreacted strontium source.

Preferably the pH is adjusted, in the acid treatment, to from 2.5 to 7.0 using hydrochloric acid, while adjusting pH to from 4.5 to 6.0 is more preferred.

Acids other than hydrochloric acid, e.g., nitric acid, acetic acid, and so forth, can be used for the acid in the acid treatment. However, strontium sulfate, which has a low water solubility, is readily produced when sulfuric acid is used.

To improve the charge regulation and environmental stability, the strontium titanate particle may be subjected to a surface treatment with an inorganic oxide, e.g., $SiO_2$, $Al_2O_3$, and so forth, or a hydrophobic agent, e.g., a titanium coupling agent, silane coupling agent, silicone oil, fatty acid metal salt, and so forth.

A coupling agent bearing a functional group such as the amino group, fluorine, and so forth may be used for the aforementioned coupling agent.

The fatty acid metal salt can be exemplified by zinc stearate, sodium stearate, calcium stearate, zinc laurate, aluminum stearate, and magnesium stearate. The same effects are also obtained with, for example, stearic acid, which is a fatty acid.

The method for carrying out the surface treatment can be exemplified by wet methods in which treatment is carried out by dissolving or dispersing the hydrophobic agent in a solvent; adding the strontium titanate fine particles to this; and removing the solvent while stirring. Dry methods may also be used in which the strontium titanate fine particles are directly mixed with the treatment agent and treatment is carried out while stirring.

The strontium titanate fine particle preferably has a special profile in its CuK x-ray diffraction spectrum. When a strontium titanate fine particle having this special profile is used, coverage of the toner particle surface is facilitated and control of the coverage ratio X2 is facilitated. Maintenance of the toner flowability is also facilitated, and this is also preferred from the standpoint of the charging stability.

Specifically, the strontium titanate fine particle preferably has a peak at in the range of 39.700°±0.150° and a peak at in the range of 46.200°±0.150° in the CuK x-ray diffraction spectrum obtained in a range of 2θ of from 10° to 90°, where θ is the Bragg angle.

Strontium titanate having peaks at these positions adopts the perovskite structure in the cubic crystal system, and the peaks at 39.700°±0.150° and 46.200°±0.150° are diffraction peaks originating with, respectively, lattice planes having Miller indices of (111) and (200).

Particles belonging to the cubic crystal system generally readily adopt a hexahedral shape for the external shape of the particle, and with strontium titanate fine particles also, the particles grow during the production process while maintaining the (100) plane and (200) plane, which correspond to facet directions of the hexahedral shape.

As a result of our research, we discovered that excellent characteristics are exhibited with the use of a strontium titanate fine particle that has the (200) plane, corresponding to a facet direction of the hexahedral shape, and the (111) plane, which corresponds to a vertex direction.

Moreover, as a result of detailed investigations, it was found that the effects are improved further when Sb/Sa is from 1.80 to 2.30 where Sa is the area of the peak at 39.700°±0.150° and Sb is the area of the peak at 46.200°±0.150°. This Sb/Sa is preferably from 1.80 to 2.25.

It is thought that smaller values of Sb/Sa provide structures that have a more robust (111) plane.

This Sb/Sa can be controlled by adjusting the molar ratio for the starting materials for the strontium titanate fine particle and by adjusting the production conditions for the strontium titanate fine particle.

Sr/Ti molar ratio for the strontium titanate fine particle is preferably from 0.70 to 0.95, more preferably from 0.70 to 0.85, and still more preferably from 0.75 to 0.83.

By adopting the indicated range for Sr/Ti molar ratio, the proportion of Ti is increased to near to negative charging in terms of charging, and as a result the assumption of a sharp charge distribution is facilitated and, during long-term endurance use, the suppression of fogging is facilitated and the maintenance of an excellent developing performance is facilitated.

Sr/Ti molar ratio can be controlled by adjusting the molar ratio for the starting materials for the strontium titanate fine particle and by adjusting its production conditions.

The silica fine particles are not particularly limited and known silica fine particles can be used.

The silica fine particles referred to as dry-produced silica or fumed silica, which are fine particles produced by the vapor-phase oxidation of a silicon halide compound, are preferred.

This dry production method, for example, uses the thermal decomposition oxidation reaction of a silicon tetrachloride gas in an oxyhydrogen flame, wherein the basic reaction formula is as follows.

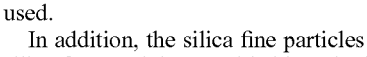

$$SiCl_4+2H_2+O_2 \rightarrow SiO_2+4HCl$$

Composite fine particles of silica and another metal oxide may also be obtained in this production process by using a combination of the silicon halide compound with another metal halide compound such as aluminum chloride or titanium chloride, and such composite fine particles may also be used.

In addition, the silica fine particles are preferably treated silica fine particles provided by a hydrophobic treatment of the surface.

In a test of wettability of the treated silica fine particles relative to a methanol/water mixed solvent, the methanol concentration at a 50% transmittance for light at a wavelength of 780 nm is preferably from 30 volume % to 80 volume %.

The hydrophobic treatment method can be exemplified by methods in which a chemical treatment is carried out with an organosilicon compound and/or a silicone oil, in either case that reacts with or physically adsorbs to the silica fine particle.

The organosilicon compound can be exemplified by the following:

hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, -chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxanes having 2 to 12 siloxane units in each molecule and having one hydroxyl group on the Si at each unit in terminal position. A single one of these may be used by itself or a mixture of two or more may be used.

Additional examples are nitrogen atom-bearing silane coupling agents such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine.

For these also, a single one may be used by itself or a mixture of two or more may be used.

Among the preceding, hexamethyldisilazane (HMDS) is a preferred example of the organosilicon compound.

The treatment amount with the organosilicon compound, per 100 mass parts of the silica fine particle, is preferably from 0.1 mass parts to 20.0 mass parts. When this range is adopted, an excellent hydrophobicity is readily obtained and control of the wettability versus a methanol/water mixed solvent into the aforementioned range is facilitated.

The silicone oil has a viscosity at 25° C. preferably of from 0.5 $mm^2$/sec to 10,000 $mm^2$/sec, more preferably from 1 $mm^2$/sec to 1,000 $mm^2$/sec, and still more preferably from 10 $mm^2$/sec to 200 $mm^2$/sec. Specific examples are dimethylsilicone oil, methylphenylsilicone oil, -methylstyrene-modified silicone oil, chlorophenylsilicone oil, and fluorine-modified silicone oil.

The following are examples of treatment methods using silicone oil: methods in which the silicone oil is directly mixed, using a mixer such as a Henschel mixer, with silica fine particles that have been treated with a silane coupling agent; methods in which the silicone oil is sprayed on the silica fine particles serving as a base; and methods in which the silicone oil is dissolved or dispersed in a suitable solvent, followed by addition of the silica fine particles with mixing and then removal of the solvent.

With silicone oil-treated silica fine particles, more preferably the surface coating is stabilized by heating the silica, after its treatment with the silicone oil, to at least 200° C. (more preferably to at least 250° C.) in an inert gas.

The amount of treatment with the silicone oil, per 100 mass parts of the silica fine particles, is preferably from 1 mass part to 40 mass parts and more preferably from 3 mass parts to 35 mass parts. An excellent hydrophobicity is readily obtained when the indicated range is adopted.

To the extent that the effects described above are not impaired, the toner may also contain other external additives besides the silica fine particle and the Group 2 element-containing titanate fine particle.

There are no particular limitations on the method for producing the toner particle. Examples here are methods in which the toner particle is directly produced in an aqueous medium, such as suspension polymerization methods, interfacial polymerization methods, and dispersion polymerization methods (also referred to below as polymerization methods); emulsion aggregation methods; pulverization methods; and methods in which a heat-sphering treatment is carried out on a toner particle obtained by a pulverization method.

Among the preceding, emulsion aggregation methods and suspension polymerization methods are preferred because they readily provide toner particles that are uniformly approximately spherical and exhibit an excellent uniformity in the charge distribution and because they facilitate the incorporation of resin having a low softening point and/or resin particles that exhibit an excellent sharp melt property.

In suspension polymerization methods, the toner particle is produced by dispersing, in an aqueous medium, a polymerizable monomer composition comprising polymerizable monomer that can produce the binder resin, colorant, wax, charge control agent, and so forth, to form particles of the polymerizable monomer composition, and polymerizing the polymerizable monomer in the particles.

In emulsion aggregation methods, an aggregate particle is obtained by inducing the aggregation of a dispersion of resin fine particles produced by a method such as dispersion of the binder resin or emulsion polymerization, a dispersion of colorant fine particles produced by dispersing a colorant in an aqueous medium, and other components (aggregation step), and thereafter inducing the fusion of the aggregate particle (fusion step) to obtain the toner particle.

The emulsion aggregation method is described in detail in the following, but the present invention is not limited to or by this.

The binder resin used can be exemplified by homopolymers and copolymers (vinyl resin) of the following: styrene and styrenic monomers such as para-chlorostyrene and -methylstyrene; acrylate ester monomers such as methyl acrylate, ethyl acrylate, n-propyl acrylate, n-butyl acrylate, lauryl acrylate, and 2-ethylhexyl acrylate; methacrylate ester monomers such as methyl methacrylate, ethyl methacrylate, n-propyl methacrylate, lauryl methacrylate, and 2-ethylhexyl methacrylate; vinyl nitriles such as acrylonitrile and methacrylonitrile; vinyl ethers such as vinyl ethyl ether and vinyl isobutyl ether; and vinyl ketones such as vinyl methyl ketone, vinyl ethyl ketone, and vinyl isopropenyl ketone.

Additional examples are the homopolymers and copolymers (olefin resins) of olefins such as ethylene, propylene, butadiene, and isoprene; nonvinyl condensation resins such as epoxy resins, polyester resins, polyurethane resins, polyamide resins, cellulose resins, and polyether resins; and graft polymers of vinylic monomer with these nonvinyl condensation resins.

A single one of these resins may be used by itself or two or more may be used in combination.

Among the preceding, polyester resins, which exhibit a sharp melt property and have an excellent strength even at low molecular weights, are preferred.

The colorant used can be exemplified by known organic pigments and dyes, carbon black, a magnetic body, and so forth.

Cyan colorants can be exemplified by copper phthalocyanine compounds and their derivatives, anthraquinone compounds, and basic dye lake compounds.

Specific examples are C. I. Pigment Blue 1, 7, 15, 15:1, 15:2, 15:3, 15:4, 60, 62, and 66.

Magenta colorants can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are C. I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254 and C. I. Pigment Violet 19.

Yellow colorants can be exemplified by condensed azo compounds, isoindolinone compounds, anthraquinone compounds, azo metal complexes, methine compounds, and allylamide compounds.

Specific examples are C. I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 191 and 194.

Black colorants are exemplified by carbon black, magnetic bodies, and black colorants provided by color mixing a yellow colorant, magenta colorant, and cyan colorant to give a black color.

A single one of these colorants may be used or a mixture may be used, and these colorants may also be used in a solid solution state. The colorant may be selected considering the hue angle, chroma, lightness, lightfastness, OHP transparency, and dispersibility in the toner particle.

The colorant content is preferably from 1 mass part to 20 mass parts per 100 mass parts of the binder resin.

The resin fine particle dispersion is prepared using a known dispersion method. Specifically, an aqueous medium, an emulsifying agent, and so forth are combined with the binder resin and dispersion is carried out using a device that applies a high-velocity shear force, e.g., a Clearmix, homomixer, or homogenizer. That is, this is a method that produces a resin fine particle dispersion in an aqueous medium through emulsification using external shear force.

On the other hand, the resin fine particle dispersion may also be produced by an inversion emulsification method, wherein the binder resin is dissolved in a solvent; this is dispersed, using a disperser such as a homogenizer, into particulate form in an aqueous medium along with, e.g., an emulsifying agent, polyelectrolyte, and so forth; and the solvent is thereafter removed by the application of heat or under reduced pressure. Or, in the case of a resin fine particle dispersion containing resin fine particles in which vinylic monomer is a constituent component, the resin fine particle dispersion may be prepared by the execution of emulsion polymerization using an emulsifying agent.

The colorant fine particle dispersion may be prepared by dispersing fine particles of the colorant in an aqueous medium.

The colorant particles are dispersed by a known method. The use is preferred, for example, of a rotating shear-type homogenizer; a media-based disperser, e.g., a ball mill, sand mill, attritor, and so forth; or a high-pressure collision-type disperser. The use is preferred in particular of a Nanomizer from Yoshida Kikai Co., Ltd., Ultimizer from Sugino Machine Limited, and Nanogenizer LPN Series from Serendip AG, which are high-pressure collision-type dispersers.

There are no particular limitations on the emulsifying agent that can be used in the preparation of these dispersions, and the emulsifying agent can be exemplified by anionic surfactants such as sulfate ester salt types, sulfonate salt types, phosphate ester types, and soap types; cationic surfactants such as amine salt types and quaternary ammonium salt types; and nonionic surfactants such as polyethylene glycol types, ethylene oxide adducts on alkylphenols, and polyhydric alcohols. A single emulsifying agent may be used by itself or two or more may be used in combination.

The anionic surfactant is specifically exemplified by fatty acid soaps such as potassium laurate, sodium oleate, and sodium castor oil; sulfate esters such as octyl sulfate, lauryl sulfate, lauryl ether sulfate, and nonylphenyl ether sulfate; alkylnaphthalenesulfonate salts such as laurylsulfonate, dodecylbenzenesulfonate, triisopropylnaphthalenesulfonate, and dibutylnaphthalenesulfonate; sulfonate salts such as naphthalenesulfonate-formalin condensate, monooctyl sulfosuccinate, dioctyl sulfosuccinate, lauramide sulfonate, and oleamide sulfonate; phosphate esters such as lauryl phosphate, isopropyl phosphate, and nonylphenyl ether phosphate; dialkyl sulfosuccinate salts such as sodium dioctyl sulfosuccinate; and sulfosuccinate salts such as disodium lauryl sulfosuccinate.

The cationic surfactant is specifically exemplified by amine salts such as laurylamine hydrochloride, stearylamine hydrochloride, oleylamine acetate, stearylamine acetate, and stearylaminopropylamine acetate, and by quaternary ammonium salts such as lauryltrimethylammonium chloride, dilauryldimethylammonium chloride, stearyltrimethylammonium chloride, distearyldimethylammonium chloride, lauryldihydroxyethylmethylammonium chloride, oleylbis(polyoxyethylene)methylammonium chloride, lauroylaminopropyldimethylethylammonium ethosulfate, lauroylaminopropyldimethylhydroxyethylammonium perchlorate, alkylbenzenetrimethylammonium chloride, and alkyltrimethylammonium chloride.

Specific examples of nonionic surfactants are alkyl ethers such as polyoxyethylene octyl ether, polyoxyethylene lauryl ether, polyoxyethylene stearyl ether, and polyoxyethylene oleyl ether; alkylphenyl ethers such as polyoxyethylene octylphenyl ether and polyoxyethylene nonylphenyl ether; alkyl esters such as polyoxyethylene laurate, polyoxyethylene stearate, and polyoxyethylene oleate; alkylamines such as polyoxyethylene laurylamino ether, polyoxyethylene stearylamino ether, polyoxyethylene oleylamino ether, polyoxyethylene soy amino ether, and polyoxyethylene tallow amino ether; alkylamides such as polyoxyethylene lauramide, polyoxyethylene stearamide, and polyoxyethylene oleamide; plant oil ethers such as polyoxyethylene castor oil ether and polyoxyethylene rapeseed oil ether; alkanolamides such as diethanolamide laurate, diethanolamide stearate, and diethanolamide oleate; and sorbitan ester ethers such as polyoxyethylene sorbitan monolaurate, polyoxyethylene sorbitan monopalmitate, polyoxyethylene sorbitan monostearate, and polyoxyethylene sorbitan monooleate.

Aggregation Step

In the aggregation step, a mixture is prepared by mixing the resin fine particle dispersion, the colorant fine particle dispersion, and the other components. All of these fine particles present in the thusly prepared mixture then undergo aggregation to form an aggregate particle having the intended toner particle diameter. Here, an aggregate particle provided by the aggregation of the resin fine particles, colorant fine particles, and other components may be formed by the addition of an aggregating agent with mixing and as necessary by the application as appropriate of heat and/or mechanical force.

In addition, an aggregate particle may optionally be formed that has a core/shell structure in which a shell layer is formed on a core aggregate particle. An aggregate particle having a core/shell structure may be prepared, for example, as described in the following.

In a first aggregation step of forming the core aggregate particle, the various fine particles present in the mixture are aggregated to form aggregate particles and thereby produce a dispersion of aggregate particles. Here, for example, the core aggregate particle can be formed by adding a pH modifier, aggregating agent, and/or stabilizer to the mixture and applying heat and/or mechanical force as appropriate.

The pH modifier can be exemplified by ammonia, alkalis such as sodium hydroxide, and acids such as nitric acid and citric acid.

The aggregating agent can be exemplified by the salts of monovalent metals such as sodium and potassium; the salts of divalent metals such as calcium and magnesium; the salts of trivalent metals such as iron and aluminum; and alcohols such as methanol, ethanol, and propanol.

The stabilizer can be exemplified mainly by polar surfactants per se and by aqueous media containing same. For example, when the polar surfactant present in the aforementioned individual dispersions is anionic, a cationic polar surfactant can then be selected as the stabilizer.

The addition and mixing of the aggregating agent and so forth is preferably carried out at or below the glass transition temperature of the binder resin present in the mixture. When mixing is carried out using this temperature condition, the process can go forward in an aggregation-stabilized state.

Mixing can be carried out using, for example, a homogenizer, mixer, and so forth.

The second aggregation step, in which the shell layer is formed, is a step of forming a coating layer (shell layer) that uses a resin fine particle dispersion containing a second resin fine particle, wherein second resin fine particles are attached to the surface of the core aggregate particle obtained in the first aggregation step. By doing this, an aggregate particle is obtained that has a core/shell structure in which a shell layer is formed on the surface of the core aggregate particle.

The second resin fine particle may be the same as the first resin fine particle or may differ therefrom. In addition, the first aggregation step and the second aggregation step may each be divided into a plurality of stages and may be executed repetitively.

Fusion Step

The fusion step is a step in which the aggregate particle having a core/shell structure is heated to effect fusion or coalescence.

Prior to entry into the fusion step, for example, a pH modifier, polar surfactant, nonpolar surfactant, and so forth as described above may be introduced as appropriate in order to prevent toner particle-to-toner particle melt-adhesion.

The heating temperature should be below the decomposition temperature of the resin and equal to or greater than the glass transition temperature of the resin present in the aggregate particle having a core/shell structure (when two or more species of resin are present, this is the glass transition temperature of the resin having the highest glass transition temperature).

Accordingly, the heating temperature will vary in correspondence to the species of resin constituting the resin fine particle and thus cannot be unconditionally stipulated; however, on an approximate basis, it will generally be at least the glass transition temperature of the resin present in the aggregate particle having a core/shell structure and not more than 140° C. Heating may be carried out using a known heating device.

With regard to the fusion time, shorter times will be sufficient at higher heating temperatures while longer times will be required at lower heating temperatures. That is, the fusion time cannot be unconditionally stipulated because it depends on the heating temperature; however, it will generally be about from 30 minutes to 10 hours.

This fusion step may have a primary fusion step, in which the core particle is obtained by the thermal fusion of the core aggregate particle obtained in the first aggregation step, and a secondary fusion step, in which the second resin fine particles are attached to the surface of the obtained core particle to form a coating layer (shell layer) followed by thermal fusion to yield a resin particle having a core/shell structure.

The toner particles yielded by the execution of these individual steps can be subjected to solid-liquid separation according to a known method to recover the toner particles, followed by washing and drying under suitable conditions.

The weight-average particle diameter (D4) of the toner particle is preferably from 4.5 μm to 7.0 μm and is more preferably from 5.0 μm to 6.5 μm.

The methods used to measure the various properties associated with the toner and other materials are described in the following.

Method for Quantitating the Silica Fine Particle 3 g of the toner is introduced into an aluminum ring having a diameter of 30 mm and a pellet is fabricated at a pressure of 10 tons.

The intensity for silica (Si) is determined (Si intensity-1) by wavelength-dispersive x-ray fluorescence analysis (XRF). While the measurement conditions should be optimized for the XRF instrument used, all of the intensity measurements in a measurement series are run under the same conditions.

1.0 mass %, with reference to the toner particles, of silica fine particles having a number-average primary particle diameter of 12 nm is added to the toner particles and mixing is performed using a coffee mill.

After mixing, pelletization is carried out as above and the intensity for Si is determined as above (Si intensity-2). The intensity for Si is determined using the same procedure for samples provided by the addition with mixing of 2.0 mass % and 3.0 mass % of the silica fine particles with reference to the toner particles (Si intensity-3, Si intensity-4). Using Si intensities-1 to -4, the silica content (mass %) in the toner particle is determined by the method of standard addition.

Method for Quantitating the Group 2 Element-Containing Titanate Fine Particle

The Group 2 element-containing titanate fine particle is quantitated by carrying out quantitation by the method of standard addition as in the Method for quantitating the silica fine particle described above.

When a strontium titanate fine particle is used as the Group 2 element-containing titanate fine particle, a strontium titanate fine particle having a number-average primary particle diameter of 35 nm is used and quantitation is performed by wavelength-dispersive x-ray fluorescence analysis (XRF) using the intensity for Sr.

When another Group 2 element-containing titanate fine particle has been incorporated in the toner, quantitation is performed as described above by the method of standard addition using the same Group 2 element-containing titanate fine particle, with judicious selection of the XRF target.

Method for Measuring the Coverage Ratio X1 and the Coverage Ratio X2

The coverage ratio X1 of the toner surface by the silica fine particle and the coverage ratio X2 of the toner surface by the inorganic fine particle A are calculated as described in the following.

Elemental analysis of the toner surface is carried using the following instrument under the following conditions.

measurement instrument: Quantum 2000 x-ray photoelectron spectrometer (product name, Ulvac-Phi, Inc.)
x-ray source: monochrome Al K
x-ray setting: 100 μmϕ (25 W (15 kV))
photoelectron extraction angle: 45°
neutralization conditions: combined use of neutralizing gun and ion gun
region of analysis: 300×200 μm
pass energy: 58.70 eV
step size: 0.125 eV
analysis software: MultiPak (Physical Electronics Inc.)

Here, the peaks for C 1s (B. E. 280 to 295 eV), O 1s (B. E. 525 to 540 eV), Si 2p (B. E. 95 to 113 eV), and Ti 2p (B. E. 452 to 468 eV) are used to calculate the quantitative values for the Si atom and Ti atom. The quantitative value obtained here for the element Si is designated Y1, and the quantitative value for the element Ti is designated Z1.

Then, proceeding as in the aforementioned elemental analysis of the toner surface, elemental analysis is performed on the silica fine particle itself and on the inorganic fine particle A itself (Group 2 element-containing titanate fine particle), and the quantitative value thereby obtained for the element Si is designated Y2 and the quantitative value for the element Ti is designated Z2.

The coverage ratio X1 of the toner surface by the silica fine particle and the coverage ratio X2 of the toner surface by the inorganic fine particle A are defined by the following formulas using this Y1, Y2, Z1, and Z2.

$$\text{coverage ratio } X1(\%)=Y1/Y2\times 100$$

$$\text{coverage ratio } X2(\%)=Z1/Z2\times 100$$

Y1 and Y2 are preferably measured at least twice each in order to improve the accuracy of this measurement. If the silica fine particle and inorganic fine particle A used for external addition can be obtained, the measurement for the determination of the quantitative values Y2 and Z2 may be carried out using these.

The silica fine particle and Group 2 element-containing titanate fine particle are separated from the toner using the following procedure when the silica fine particle or Group 2 element-containing titanate fine particle separated from the toner surface is to be used as the measurement sample.

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.) are introduced into a centrifugal separation tube to prepare a dispersion. 1 g of the toner is added to this dispersion, and clumps of the toner are broken up using, for example, a spatula.

The centrifugal separation tube is placed in a KM Shaker (model: V. SX) from Iwaki Sangyo Co., Ltd., and shaking is carried out for 20 minutes at 350 oscillations per minute. After shaking, the solution is transferred over to a glass tube (50 mL) for swing rotor service, and centrifugal separation is performed in a centrifugal separator using conditions of 3,500 rpm and 30 minutes.

In the glass tube after centrifugation separation, the toner is present in the uppermost layer and the silica fine particles and Group 2 element-containing titanate fine particles are present in the lower layer aqueous solution. The lower layer aqueous solution is recovered and centrifugal separation is performed to separate the sucrose from the silica fine particles and Group 2 element-containing titanate fine particles, and the silica fine particles and Group 2 element-containing titanate fine particles are collected.

Centrifugal separation may be carried out repetitively as necessary, and, once a satisfactory separation has been obtained, the dispersion is dried and the silica fine particles and Group 2 element-containing titanate fine particles are collected.

Using a centrifugal separation procedure, the silica fine particles and Group 2 element-containing titanate fine particles are sorted out from the collected external additive. Sorting by centrifugal separation is similarly performed when an external additive other than the silica fine particle and Group 2 element-containing titanate fine particle has been added.

Method for Measuring the Weight-Average Particle Diameter (D4) of the Toner Particles The weight-average particle diameter (D4) of the toner particles is determined as follows (this same determination is also used for the toner). The measurement instrument used is a Coulter Counter Multisizer 3 (registered trademark, Beckman Coulter, Inc.), a precision particle size distribution measurement instrument operating on the pore electrical resistance method and equipped with a 100 μm aperture tube. The measurement conditions are set and the measurement data is analyzed using the accompanying dedicated software, i.e., Beckman Coulter Multisizer 3 Version 3.51 (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of approximately 1 mass % and, for example, ISOTON II (from Beckman Coulter, Inc.) can be used.

The dedicated software is configured as follows prior to measurement and analysis.

In the modify the standard operating method (SOM) screen in the dedicated software, the total count number in the control mode is set to 50,000 particles; the number of measurements is set to 1 time of measurement; and the Kd value is set to the value obtained using standard particle 10.0 μm (Beckman Coulter, Inc.). The threshold value and noise level are automatically set by pressing the threshold value/noise level measurement button. In addition, the current is set to 1,600 μA; the gain is set to 2; the electrolyte is set to ISOTON II; and a check is entered for the post-measurement aperture tube flush.

In the setting conversion from pulses to particle diameter screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL round-bottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the aperture flush function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the approximately three-fold (mass) dilution with deionized water of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) An Ultrasonic Dispersion System Tetora 150 (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of deionized water is introduced into the water tank of this ultrasound disperser and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner particles is added to the aqueous electrolyte solution in small aliquots and dispersion is carried out. The ultrasound dispersion treatment is continued for an additional 60 seconds. The water temperature in the water tank is adjusted as appropriate during ultrasound dispersion to be from 10° C. to 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the average diameter on the analysis/volumetric statistical value (arithmetic average) screen is the weight-average particle diameter (D4).

Method for Measuring the Number-Average Particle Diameter (D1) of the Primary Particle of the Silica Fine Particle and the Inorganic Fine Particle A (i.e., the Group 2 Element-Containing Titanate Fine Particle)

The number-average particle diameter of the primary particle of the silica fine particles and the Group 2 element-containing titanate fine particles is calculated from the image of the silica fine particles and Group 2 element-containing titanate fine particles on the toner surface taken with the Hitachi S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the toner is sprayed onto this. Blowing with air is additionally performed to remove excess toner from the specimen stub and carry out thorough drying. The specimen stub is set in the specimen holder and the specimen stub height is adjusted to 36 mm with the specimen height gauge.

(2) Setting the Conditions for Observation with the S-4800

Calculation of the number-average particle diameter of the primary particle of the silica fine particles and the Group 2 element-containing titanate fine particles is carried out using the images obtained by backscattered electron image observation with the S-4800. The particle diameter can be measured with excellent accuracy using the backscattered electron image because charge up of the particles is less than for the secondary electron image.

Liquid nitrogen is introduced to the brim of the anti-contamination trap attached to the S-4800 housing and standing for 30 minutes is carried out. The PCSTEM of the S-4800 is started and flashing is performed (the FE tip, which is the electron source, is cleaned). The acceleration voltage display area in the control panel on the screen is clicked and the [flashing] button is pressed to open the flashing execution dialog. A flashing intensity of 2 is confirmed and execution is carried out. The emission current due to flashing is confirmed to be 20 to 40 μA. The specimen holder is inserted in the specimen chamber of the S-4800 housing. [home] is pressed on the control panel to transfer the specimen holder to the observation position. The acceleration voltage display area is clicked to open the HV setting dialog and the acceleration voltage is set to [0.8 kV] and the emission current is set to [20 μA]. In the [base] tab of the operation panel, signal selection is set to [SE]; [upper (U)] and [+BSE] are selected for the SE detector; and [L.A. 100] is selected in the selection box to the right of [+BSE] to go into the observation mode using the backscattered electron image. Similarly, in the [base] tab of the operation panel, the probe current of the electron optical system condition block is set to [Normal]; the focus mode is set to [UHR]; and WD is set to [3.0 mm]. The [ON] button in the acceleration voltage display area of the control panel is pushed to apply the acceleration voltage.

(3) Calculation of the Number-Average Particle Diameter (D1) of the Primary Particle of the Silica Fine Particles and Group 2 Element-Containing Titanate Fine Particles The magnification is set to 100,000× (100 k) by dragging within the magnification indicator area of the control panel. The [COARSE] focus knob on the operation panel is turned and adjustment of the aperture alignment is performed when some degree of focus has been obtained. [Align] is clicked in the control panel and the alignment dialog is displayed and [beam] is selected. The displayed beam is migrated to the center of the concentric circles by turning the STIGMA/

ALIGNMENT knobs (X, Y) on the operation panel. [aperture] is then selected and the STIGMA/ALIGNMENT knobs (X, Y) are turned one at a time to adjust so as to stop the motion of the image or minimize the motion. The aperture dialog is closed and focusing is done with the autofocus. This operation is repeated an additional two times to achieve focus.

After this, the average particle diameter is determined by measuring the particle diameter for at least 300 silica fine particles of equal to or less than 100 nm on the toner particle surface. The average particle diameter is also determined for the Group 2 element-containing titanate fine particles by similarly measuring the particle diameter for at least 300 particles of equal to or less than 100 nm.

Here, since the silica fine particles and Group 2 element-containing titanate fine particles may also be present as aggregates, the major diameter is determined on fine particles that can be confirmed to be primary particle, and the number-average particle diameter (D1) of the primary particle of the silica fine particles and Group 2 element-containing titanate fine particles is obtained by taking the arithmetic average of the obtained major diameters.

STEM-EDS measurement is carried out to determine whether the observed fine particles are a silica fine particle or an inorganic fine particle A (Group 2 element-containing titanate fine particle).

The measurement conditions are as follows.

Model JEM-2800 transmission electron microscope: acceleration voltage=200 kV

EDS detector: JED-2300T (JEOL Ltd., element area=100 $mm^2$)

EDS analyzer: Noran System 7 (Thermo Fisher Scientific Inc.)

X-ray storage rate: 10,000 to 15,000 cps

Dead time: The EDS analysis (cumulative number=100 or measurement time=5 min) is carried out with the electron beam dose adjusted to provide 20% to 30%.

Method for Measuring the Fixing Ratio of the Inorganic Fine Particle A (i.e., the Group 2 Element-Containing Titanate Fine Particle)

Samples are first prepared as follows.

Pre-water-wash toner: The toner produced in the particular example, see below, is used directly.

Post-water-wash toner: A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.) are introduced into a centrifugal separation tube to prepare a dispersion. 1 g of the toner is added to this dispersion, and clumps of the toner are broken up using, for example, a spatula.

The centrifugal separation tube is placed in a KM Shaker (model: V. SX) from Iwaki Sangyo Co., Ltd., and shaking is carried out for 20 minutes at 350 oscillations per minute. After shaking, the solution is transferred over to a glass tube (50 mL) for swing rotor service, and centrifugal separation is performed in a centrifugal separator using conditions of 3,500 rpm and 30 minutes.

After visually checking that the toner and aqueous solution have been satisfactorily separated, the toner, which is separated into the uppermost layer, is recovered using, for example, a spatula.

A slurry containing the recovered toner is filtered on a vacuum filter, followed by drying for at least 1 hour in a dryer to obtain the post-water-washed toner.

The Group 2 element-containing titanate fine particle is quantitated for this pre-water-washed toner and post-water-washed toner by using the intensity for the target element (Sr when a strontium titanate fine particle is used for the Group 2 element-containing titanate fine particle) provided by wavelength-dispersive x-ray fluorescence analysis (XRF), and the fixing ratio is then calculated.

Approximately 1 g of the pre-water-washed toner or post-water-washed toner is introduced into a specialized aluminum compaction ring and is smoothed over, and, using a BRE-32 tablet compression molder (Maekawa Testing Machine Mfg. Co., Ltd.), a pellet is produced by molding to a thickness of approximately 2 mm by compression for 60 seconds at 20 MPa. An Axios wavelength-dispersive x-ray fluorescence analyzer (PANalytical B.V.) is used for the measurement, and the SuperQ ver. 4.0F (PANalytical B.V.) software provided with the instrument is used to set the measurement conditions and analyze the measurement data.

Rh is used for the x-ray tube anode; a vacuum is used for the measurement atmosphere; the measurement diameter (collimator mask diameter) is 10 mm; and the measurement time is 10 seconds.

A proportional counter (PC) is used for measurement of the light elements, and a scintillation counter (SC) is used for measurement of the heavy elements. With the measurement being carried out under the conditions indicated above, the elements are identified based on the obtained x-ray peak positions and their concentration is calculated from the count rate (unit: cps), which is the number of x-ray photons per unit time.

The element intensity is determined for the pre-water-wash toner and the post-water-wash toner using this method. The fixing ratio is then calculated using the formula given below.

For example, the formula is given below for the case of use of a strontium titanate fine particle as the Group 2 element-containing titanate fine particle and the use of Sr as the target element.

(The calculation can be carried out by the same method by selecting a suitable target element in conformity to the species of Group 2 element-containing titanate fine particle.)

Fixing ratio (%) of the inorganic fine particle $A$=(intensity of element Sr for the post-water-wash toner)/(intensity of element Sr for the pre-water-wash toner)×100

Method for Measuring the Diffraction Peaks for the Strontium Titanate Fine Particle The diffraction peaks for the strontium titanate fine particle are measured using a SmartLab powder x-ray diffractometer (Rigaku Corporation, a powerful horizontal sample-type x-ray diffractometer).

Sb/Sa is calculated from the obtained peaks using the PDXL2 (version 2.2.2.0) analytical software provided with this instrument.

The toner or the strontium titanate fine particles isolated from the toner are used as the measurement sample, and the measurement is carried out using the following procedure. The produced strontium titanate fine particles are also measured in the examples given below.

Sample Preparation

Measurement is carried out after the measurement sample has been uniformly introduced into a 0.5 mm-diameter Boro-Silicate capillary (W. Muller).

Measurement Conditions tube: Cu
optical system: CBO-E
sample platform: capillary sample platform
detector: D/tex Ultra250 detector
voltage: 45 kV
current: 200 mA
start angle: 10°
final angle: 90°
sampling width: 0.02°
speed measurement time set value: 10
IS: 1 mm
RS1: 20 mm
RS2: 20 mm
attenuator: open
set value for capillary rotation: 100

The initial settings on the instrument are used for the other conditions.

Analysis

Peak separation processing is first carried out on the obtained peaks using the PDXL2 software provided with the instrument. Peak separation is determined by carrying out optimization using the split Voight function that can be selected with the PDXL, and the obtained integral intensity values are used.

The 2θ value of the diffraction peak top and its area are thereby determined. Sb/Sa is calculated from the peak areas at the prescribed 2θ values. When a large deviation occurs here between the calculated results for peak separation and the actually measured spectrum, processing is performed, such as, for example, setting the baseline manually, and adjustment is made to bring the calculated result into agreement with the actually measured spectrum.

Measurement of the Sr/Ti Molar Ratio of the Strontium Titanate Fine Particle

The Sr and Ti contents in the strontium titanate fine particle are measured using a wavelength-dispersive x-ray fluorescence analyzer (Axios Advanced, PANalytical B.V.). 1 g of the sample is weighed onto a specialized film pasted in a specialized powder measurement cup, as recommended by PANalytical B.V., and the elements from Na to U are measured on the strontium titanate fine particle by the FP method at atmospheric pressure under a helium atmosphere.

In this case, all of the detected elements are assumed to be present as the oxide, and, using their total mass as 100%, the SrO content and $TiO_2$ content (mass %) are determined as the values as the oxide with respect to the total mass using Spectra Evaluation (version 5.0L) software. After this, Sr/Ti (mass ratio) is determined by subtracting the oxygen from the quantitative results, and conversion to Sr/Ti (molar ratio) is then performed from the atomic weights of the respective elements.

The sample used is obtained by isolating the strontium titanate fine particles from the toner. In the examples given below, the produced strontium titanate fine particles are also measured.

Measurement of the Average Circularity of the Primary Particle of the Inorganic Fine Particle A The average circularity of the primary particle of the inorganic fine particle A (that is, the Group 2 element-containing titanate fine particle) is measured using a JEM-2800 transmission electron microscope (JEOL Ltd.). The observation is performed on toner to which the inorganic fine particle A has been externally added, and the determination is carried out as follows.

The observation magnification is adjusted as appropriate depending on the size of the inorganic fine particle A.

Using Image-Pro Plus 5.1J (Media Cybernetics, Inc.) image processing software, the circle-equivalent diameter of 100 randomly selected inorganic fine particles A and the peripheral length of the particles are measured in a field magnified by a maximum 200,000× and the average circularity is calculated. The circle-equivalent diameter is the diameter of the circle having the same area as the projected area of the particle.

The circularity is calculated using the following formula, and the average circularity is taken to be the arithmetic average value thereof.

$$\text{circularity}=\text{circle-equivalent diameter}\times 3.14/\text{peripheral length of the particle}$$

The determination of whether the observed fine particle is an inorganic fine particle A, i.e., a Group element-containing titanate fine particle, is performed by STEM-EDS measurement. The measurement conditions are as for the method described above.

Method for Measuring the Hydrophobicity (Volume %) of the Inorganic Fine Particle A and the Silica Fine Particle The hydrophobicity (volume %) of the inorganic fine particle A and the silica fine particle is measured using a WET-100P powder wettability tester (Rhesca Co., Ltd.).

A fluororesin-coated spindle-shaped stir bar having a length of 25 mm and a maximum barrel diameter of 8 mm is introduced into a cylindrical glass vessel having a diameter of 5 cm and a thickness of 1.75 mm.

70 mL of aqueous methanol composed of 50 volume % methanol and 50 volume % water is introduced into the cylindrical glass vessel. 0.5 g of the inorganic fine particle A or silica fine particle isolated from the toner is then added and the vessel is set in the powder wettability tester.

While stirring at a rate of 200 rpm using a magnetic stirrer, methanol is added through the powder wettability tester into the liquid at a rate of 0.8 mL/min.

The transmittance of light at a wavelength of 780 nm is measured, and the hydrophobicity is taken to be the value given by the volume percent of methanol when the transmittance reaches 50% (=(volume of methanol/volume of mixture)×100). The starting volume ratio between the methanol and water may be adjusted as appropriate in conformity with the hydrophobicity of the sample. In addition, the measurement is also carried out in the following examples on the produced inorganic fine particle A and silica fine particle.

EXAMPLES

The present invention is described in additional detail using the examples and comparative examples provided below; however, the present invention is in no way limited to or by these. Unless specifically indicated otherwise, the number of parts in the examples and comparative examples is on a mass basis in all instances.

Inorganic fine particles A1 to A14 were produced proceeding as follows. The properties of inorganic fine particles A1 to A14 are given in Table 1.

Inorganic Fine Particle A1 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.16 mol of an aqueous strontium chloride solution was added to this deflocculated metatitanic acid slurry to bring Sr/Ti molar ratio to 1.15, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-type particle compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration/washing was dried for 8 hours in the atmosphere at 120° C. to obtain inorganic fine particle A1 (strontium titanate fine particle).

Inorganic Fine Particle A2 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.16 mol of an aqueous strontium chloride solution was added to this deflocculated metatitanic acid slurry to bring Sr/Ti molar ratio to 1.15, and the $TiO_2$ concentration was then adjusted to 1.083 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-type particle compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration/washing was dried for 8 hours in the atmosphere at 120° C. to obtain inorganic fine particle A2 (strontium titanate fine particle).

Inorganic Fine Particle A3 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.16 mol of an aqueous strontium chloride solution was added to this deflocculated metatitanic acid slurry to bring Sr/Ti molar ratio to 1.15, and the $TiO_2$ concentration was then adjusted to 1.015 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-type particle compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration/washing was dried for 8 hours in the atmosphere at 120° C. to obtain inorganic fine particle A3 (strontium titanate fine particle).

Inorganic Fine Particle A4 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.16 mol of an aqueous strontium chloride solution was added to this deflocculated metatitanic acid slurry to bring Sr/Ti molar ratio to 1.15, and the $TiO_2$ concentration was then adjusted to 0.988 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-type particle compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration/washing was dried for 8 hours in the atmosphere at 120° C. to obtain inorganic fine particle A4 (strontium titanate fine particle).

Inorganic Fine Particle A5 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.16 mol of an aqueous strontium chloride solution was added to this deflocculated metatitanic acid slurry to bring Sr/Ti molar ratio to 1.15, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-type particle compositing device (Nobilta NOB-130, Hosokawa Micron Corporation). Treatment was carried out for 15 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration/washing was dried for 8 hours in the atmosphere at 120° C. to obtain inorganic fine particle A5 (strontium titanate fine particle).

Inorganic Fine Particle A6 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.16 mol of an aqueous strontium chloride solution was added to this deflocculated metatitanic acid slurry to bring Sr/Ti molar ratio to 1.15, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-type particle compositing device (Nobilta NOB-130, Hosokawa Micron Corporation). Treatment was carried out for 5 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration/washing was dried for 8 hours in the atmosphere at 120° C. to obtain inorganic fine particle A6 (strontium titanate fine particle).

Inorganic Fine Particle A7 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.01 mol of an aqueous strontium chloride solution was added to this deflocculated metatitanic acid slurry to bring Sr/Ti molar ratio to 1.07, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-type particle compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration/washing was dried for 8 hours in the atmosphere at 120° C. to obtain inorganic fine particle A7 (strontium titanate fine particle).

Inorganic Fine Particle A8 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.54 mol of an aqueous strontium chloride solution was added to this deflocculated metatitanic acid slurry to bring Sr/Ti molar ratio to 1.35, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-type particle compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration/washing was dried for 8 hours in the atmosphere at 120° C. to obtain inorganic fine particle A8 (strontium titanate fine particle).

Inorganic Fine Particle A9 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.54 mol of an aqueous strontium chloride solution was added to this deflocculated metatitanic acid slurry to bring Sr/Ti molar ratio to 1.35, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-type particle compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 70° C.; sodium stearate was added at 4.0 mass % with reference to the solids fraction; and stirring and holding were continued for 1 hour. The pH was adjusted to 6.5 by the addition of a 5 mol/L sodium hydroxide solution and stirring was continued for 1 hour, after which the cake obtained by filtration/washing was dried for 8 hours in the atmosphere at 120° C. to obtain inorganic fine particle A9 (strontium titanate fine particle).

Inorganic Fine Particle A10 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.54 mol of an aqueous strontium chloride solution was added to this deflocculated metatitanic acid slurry to bring Sr/Ti molar ratio to 1.35, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

Using a Hybridizer (Nara Machinery Co., Ltd.), the dry product was then subjected three times to a 3-minute treatment at 6,000 rotations.

Hydrochloric acid was added to the dry product until the pH reached 0.1 and stirring was continued for 1 hour. The obtained precipitate was washed by decantation, and the cake obtained by filtration/washing was dried for 8 hours in the atmosphere at 120° C. to obtain inorganic fine particle A10 (strontium titanate fine particle).

Inorganic Fine Particle A11 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.16 mol of an aqueous strontium chloride solution was added to this deflocculated metatitanic acid slurry to bring Sr/Ti molar ratio to 1.15, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 1 hour. The resulting precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration/washing was dried for 8 hours in the atmosphere at 120° C. to obtain inorganic fine particle A11 (strontium titanate fine particle).

Inorganic Fine Particle A12 Production Example

A metatitanic acid slurry obtained by the hydrolysis of an aqueous titanyl sulfate solution was washed with an aqueous alkali solution.

Hydrochloric acid was then added to the metatitanic acid slurry to adjust the pH to 0.65 and thereby obtain a titania sol dispersion.

The pH of the dispersion was adjusted to 4.5 by adding NaOH to the titania sol dispersion, and washing was repeated until the electrical conductivity of the supernatant reached 70 μS/cm.

Strontium hydroxide octahydrate was added at 0.97-fold on a molar basis to the metatitanic acid slurry, followed by introduction into a stainless steel reactor and substitution with nitrogen gas.

Distilled water was added to bring to 0.5 mol/L as $TiO_2$. The slurry was heated in a nitrogen atmosphere to 83° C. at 6.5° C./h, and a reaction was run for 6 hours after 83° C. had been reached. The resulting precipitate was washed by decantation followed by filtration/separation and then drying for 8 hours in the atmosphere at 120° C. to obtain inorganic fine particle A12 (strontium titanate fine particle).

Inorganic Fine Particle A13 Production Example

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized/deflocculated metatitanic acid was recovered and was introduced into a 3 L reactor. 2.16 mol of an aqueous strontium chloride solution was added to this deflocculated metatitanic acid slurry to bring Sr/Ti molar ratio to 1.15, and the $TiO_2$ concentration was then adjusted to 0.960 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction. The reaction slurry was cooled to 50° C.; hydrochloric acid was added until the pH reached 5.0; and stirring was continued for 20 minutes.

The resulting precipitate was washed by decantation, separated by filtration, and subsequently dried for 8 hours in the atmosphere at 120° C.

300 g of the dry product was then introduced into a dry-type particle compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration/washing was dried for 8 hours in the atmosphere at 120° C. to obtain inorganic fine particle A13 (strontium titanate fine particle).

Inorganic Fine Particle 14 Production Example

Holding a 0.92 mol/L aqueous NaOH solution at approximately 90° C., the following were continuously fed to a reactor: an aqueous $TiCl_4$ solution ($TiCl_4$ concentration=0.472 mol/L) that was heated to and held at 40° C., and an aqueous $BaCl_2$/NaOH solution ($BaCl_2$ concentration=0.258 mol/L, NaOH concentration=2.73 mol/L) from which undissolved component had been preliminarily removed and which was heated to and held at approximately 95° C. The temperature of the aqueous mixed solution was held constant at approximately 90° C. and a particulate barium titanate was produced by stirring for 2 minutes. After maturation, decantation was performed; the supernatant and precipitate were separated; and washing was carried out and the solid reaction product was recovered. The recovered solid reaction product was dried by heating at 100° C. in the atmosphere. The inorganic fine particle A14 (barium titanate fine particle) was obtained by additionally heating for 5 minutes at 700° C.

Silica Fine Particle 1 Production Example

An untreated dry silica having a number-average primary particle diameter of 12 nm was introduced into a stirrer-equipped reactor and heating to 200° C. was carried out while fluidization by stirring was performed.

The interior of the reactor was substituted by nitrogen gas; the reactor was sealed; 25 parts of a dimethylsilicone oil (viscosity=100 $mm^2$/sec) was sprayed per 100 parts of the dry silica; and stirring was continued for 30 minutes. This was followed by heating to 300° C. while stirring; stirring for an additional 2 hours and then removal; and the execution of a milling treatment to obtain the silica fine particle 1. The hydrophobicity of the silica fine particle 1 was 93 (volume %).

Silica Fine Particle 2 Production Example

A silica fine particle 2 was produced as in the Silica Fine Particle 1 Production Example, but using an untreated dry silica having a number-average primary particle diameter of 6 nm. The hydrophobicity of silica fine particle 2 was 92 (volume %).

Silica Fine Particle 3 Production Example

A silica fine particle 3 was produced as in the Silica Fine Particle 1 Production Example, but using an untreated dry silica having a number-average primary particle diameter of 45 nm. The hydrophobicity of silica fine particle 3 was 94 (volume %).

Resin Fine Particle Dispersion 1 Production Example

A dispersion medium was prepared by dissolving 0.15 parts of an anionic surfactant (NEOGEN RK, DKS Co. Ltd.) and 3.15 parts of N,N-dimethylaminoethanol (basic substance) in 146.70 parts of deionized water (aqueous medium).

This dispersion medium was introduced into a 350-mL pressure-resistant roundbottom stainless steel vessel and 150 parts of the pulverizate (particle diameter=1 to 2 mm) of a polyester resin A [composition (molar ratio)=polyoxypro-

TABLE 1

| Inorganic fine particle No. | Number-average primary particle diameter (nm) | X-ray diffraction: Presence/absence of peak at 39.700° ± 0.150° | X-ray diffraction: Presence/absence of peak at 46.200° ± 0.150° | Sb/Sa | Sr/Ti molar ratio | Average circularity of primary particles | Hydrophobicity (volume %) |
|---|---|---|---|---|---|---|---|
| A1 | 35 | Present | Present | 2.03 | 0.79 | 0.872 | 75 |
| A2 | 15 | Present | Present | 1.98 | 0.75 | 0.915 | 73 |
| A3 | 47 | Present | Present | 2.04 | 0.80 | 0.848 | 76 |
| A4 | 58 | Present | Present | 2.06 | 0.81 | 0.843 | 77 |
| A5 | 32 | Present | Present | 1.82 | 0.73 | 0.874 | 75 |
| A6 | 37 | Present | Present | 2.27 | 0.82 | 0.868 | 74 |
| A7 | 38 | Present | Present | 1.80 | 0.67 | 0.866 | 77 |
| A8 | 42 | Present | Present | 2.22 | 0.86 | 0.850 | 76 |
| A9 | 42 | Present | Present | 2.22 | 0.86 | 0.850 | 62 |
| A10 | 42 | Present | Present | 2.22 | 0.86 | 0.850 | 0 |
| A11 | 39 | Present | Present | 2.34 | 0.97 | 0.785 | 72 |
| A12 | 80 | Present | Present | 2.21 | 0.88 | 0.937 | 0 |
| A13 | 65 | Present | Present | 2.19 | 0.84 | 0.833 | 77 |
| A14 | 58 | — | — | — | — | 0.793 | 0 |

pylene(2.2)-2,2-bis(4-hydroxyphenyl)propane:polyoxyethylene(2.0)-2,2-bis(4-hydroxyphenyl)propane:terephthalic acid:fumaric acid:trimellitic acid=25:25:26:20:4, number-average molecular weight (Mn)=3,500, weight-average molecular weight (Mw)=10,300, Mw/Mn=2.9, softening point (Tm)=96° C., glass transition onset temperature (Tig)=53° C., glass transition end temperature (Teg)=58° C.] was then introduced with mixing.

A Clearmix high-speed shear emulsifier (CLM-2.2S, M Technique Co., Ltd.) was then hermetically connected to the pressure-resistant roundbottom stainless steel vessel. While heating and pressurizing at 115° C. and 0.18 MPa, the mixture within the vessel was shear-dispersed for 30 minutes using 18,000 r/min for the rotor rotation rate of the Clearmix.

Then, while maintaining the rotations at 18,000 r/min until 50° C. was reached, cooling was carried out at a cooling rate of 2.0° C./min to obtain the resin fine particle dispersion 1.

According to the results of electron microscopic observation (10,000×), the average for the short diameter of the resin fine particles was 0.22 μm; the average for the long diameter was 0.56 μm; the average for long diameter/short diameter was 2.72; the proportion of particles with a long diameter/short diameter of 1.5 to 10 was 98%; and the proportion of particles smaller than 1.5 was 2%.

Using a laser diffraction/scattering particle size distribution analyzer (LA-950, Horiba, Ltd.), the median diameter (D50) on a volume basis measured on the resin fine particles was 0.22 μm and the 95% particle diameter was 0.27 μm.

Resin Fine Particle Dispersion 2 Production Example polyester resin E 60.0 parts [composition (molar ratio)=polyoxypropylene(2.2)-2,2-bis(4-hydroxyphenyl)propane:ethylene glycol terephthalic acid:maleic acid:trimellitic acid=35:15:33:15:2, Mn=4,600, Mw=16,500, peak molecular weight (Mp)=10,400, Mw/Mn=3.6, Tig=64° C., Teg=70° C., acid value=13 mg KOH/g]

| | |
|---|---|
| anionic surfactant (NEOGEN RK, DKS Co. Ltd.) | 0.3 parts |
| N,N-dimethylaminoethanol | 1.5 parts |
| tetrahydrofuran | 200.0 parts |

The preceding were mixed and dissolved and, using a T. K. Robomix ultrahigh-speed stirrer (Primix Corporation), were stirred at 4,000 r/min. 180 parts of deionized water was added dropwise to obtain a resin fine particle dispersion 2.

Using a laser diffraction/scattering particle size distribution analyzer (LA-950, Horiba, Ltd.), the median diameter on a volume basis measured on the resin fine particles was 0.18 μm and the 95% particle diameter was 0.25 μm.

Colorant Fine Particle Dispersion Production Example

| | |
|---|---|
| cyan pigment (Pigment Blue 15:3, Dainichiseika Color & Chemicals Mfg. Co., Ltd.) | 100.0 parts |

-continued

| | |
|---|---|
| anionic surfactant (NEOGEN RK, DKS Co. Ltd.) | 15.0 parts |
| deionized water | 885.0 parts |

The preceding were mixed and dissolved and, using a Nanomizer high-pressure collision-type disperser (Yoshida Kikai Co., Ltd.), were dispersed for approximately 1 hour to prepare a colorant fine particle dispersion (solids concentration=10 mass %) in which the colorant was dispersed. The median diameter on a volume basis of the colorant fine particles was 0.2 μm.

Wax Fine Particle Dispersion Production Example

| | |
|---|---|
| ester wax (behenyl behenate, melting point = 75° C.) | 100.0 parts |
| anionic surfactant (NEOGEN RK, DKS Co. Ltd.) | 10.0 parts |
| deionized water | 880.0 parts |

The preceding were introduced into a stirrer-equipped vessel and then heated to 90° C. and, using a Clearmix W-Motion (M Technique Co., Ltd.), were subjected to dispersion processing for 60 minutes by stirring while circulating under conditions of a rotor rotation of 19,000 r/min and a screen rotation of 19,000 r/min in a shear agitation section having a rotor outer diameter of 3 cm and a clearance of 0.3 mm. This was followed by cooling to 40° C. under cooling process conditions of a rotor rotation of 1,000 r/min, a screen rotation of 0 r/min, and a cooling rate of 10° C./min to obtain a wax fine particle dispersion (solids concentration=10 mass %). The median diameter on a volume basis of the wax fine particles was 0.15 μm.

Toner Particle 1 Production Example

| | |
|---|---|
| resin fine particle dispersion 1 | 40.0 parts |
| colorant fine particle dispersion | 10.0 parts |
| wax fine particle dispersion | 20.0 parts |
| 1 mass % aqueous calcium chloride solution | 20.0 parts |
| deionized water | 110.0 parts |

Using a homogenizer (ULTRA-TURRAX T50, IKA®-Werke GmbH & Co. KG), the preceding were mixed and dispersed, followed by heating on a water bath to 45° C. while stirring with a stirring blade. After holding for 1 hour at 45° C., observation with an optical microscope confirmed that aggregate particles having an average particle diameter of approximately 5.5 μm had been formed (aggregation step).

40.0 parts of a 5 mass % aqueous trisodium citrate solution was added; the temperature was then raised to 85° C. while continuing to stir; and holding for 120 minutes yielded an aqueous dispersion that contained fused core particles (primary fusion step). Measurement of the core particle diameter gave a number-average particle diameter (D4) of 5.5 μm. Then, while continuing to stir, water was introduced into the water bath and the aqueous core particle dispersion was cooled to 25° C.

12.1 parts of the resin fine particle dispersion 2 was then added. This was followed by stirring for 10 minutes, the dropwise addition of 60.0 parts of a 2 mass % aqueous calcium chloride solution, and heating to 35° C. While in this state, a small amount of the liquid was removed on an intermittent basis and passed through a 2-μm microfilter, and stirring at 35° C. was continued until the filtrate became transparent.

Once it had been confirmed that the filtrate had become transparent and that the resin fine particles had attached to the core particles to form shell-attached bodies, the aqueous dispersion of the shell-attached bodies was heated to 40° C. and was stirred for 1 hour. This was followed by the addition of 35.0 parts of a 5 mass % aqueous trisodium citrate solution, heating to 65° C., and stirring for 3.0 hours (secondary fusion step).

The resulting liquid was cooled to 25° C. and then filtered for solid-liquid separation followed by the addition of 800 parts of deionized water to the solids and washing by stirring for 30 minutes. Filtration/solid-liquid separation was subsequently repeated. In order to eliminate the influence of residual surfactant, filtration and washing in this manner were repeated until the electrical conductivity of the filtrate became not more than 150 μS/cm.

The resulting solids were then dried to obtain toner particle 1. The weight-average particle diameter (D4) of toner particle 1 was 6.4 μm.

Toner Particle 2 Production Example 710 parts of deionized water and 850 parts of a 0.1 mol/L aqueous $Na_3PO_4$ solution were added to a four-neck vessel and were held at 60° C. while stirring at 12,000 rpm using a T. K. Homomixer high-speed stirrer (Tokushu Kika Kogyo Co., Ltd.). To this was gradually added 68 parts of a 1.0 mol/L aqueous $CaCl_2$ solution to prepare an aqueous dispersion medium that contained a microfine dispersion stabilizer.

| | |
|---|---|
| styrene | 124 parts |
| n-butyl acrylate | 36 parts |
| copper phthalocyanine pigment (Pigment Blue 15:3) | 13 parts |
| polyester resin | 10 parts |

(terephthalic acid-propylene oxide-modified bisphenol A (2 mol adduct) copolymer, acid value=10 mg KOH/g, glass transition temperature (Tg)=70° C., weight-average molecular weight (Mw)=10,500)

charge control agent 2 parts (BONTRON E88, Orient Chemical Industries Co., Ltd.)

Fischer-Tropsch wax (melting point=78° C.) 15 parts

These substances were stirred for 3 hours using an attritor (Nippon Coke & Engineering Co., Ltd.), thereby dispersing the individual components in the polymerizable monomer and preparing a monomer mixture.

20.0 parts (50% toluene solution) of the polymerization initiator 1,1,3,3-tetramethylbutyl peroxy-2-ethylhexanoate was added to the monomer mixture to prepare a polymerizable monomer composition.

The polymerizable monomer composition was introduced into the aqueous dispersion medium and granulation was performed for 5 minutes while maintaining the stirrer rotation at 9,000 rpm. The high-speed stirrer was then changed over to a propeller-type stirrer and the internal temperature was raised to 70° C. and a reaction was run for 6 hours while gently stirring.

The interior of the vessel was then raised to a temperature of 80° C. and holding was performed for 4 hours; this was followed by cooling to obtain a slurry. Dilute hydrochloric acid was added to the slurry-containing vessel to eliminate the dispersion stabilizer. Toner particle 2 was obtained by filtration, washing, and drying. The weight-average particle diameter (D4) of the obtained toner particle 2 was 6.3 μm.

Toner 1 Production Example 1.2 parts of inorganic fine particle A1 and 2.5 parts of silica fine particle 1 were externally added and mixed with 100 parts of the obtained toner particle 1 using an FM10C (Nippon Coke & Engineering Co., Ltd.).

The external addition conditions were as follows: amount of toner particle charged: 1.8 kg, rotation rate: 3,600 rpm, and external addition time: 30 minutes.

This was followed by sieving across a mesh having an aperture of 200 μm to obtain the toner 1. The properties of toner 1 are given in Table 3. The contents of the silica fine particle 1 and the inorganic fine particle A1 for toner 1 were the same as the amounts of addition during production as shown in Table 2.

Toners 2 to 24 and Comparative Toners 1 to 5 Production Example

Toners 2 to 24 and comparative toners 1 to 5 were obtained proceeding as in the Toner 1 Production Example, but changing the toner particle used, the species and amount of addition of the silica fine particle, the species and amount of addition of the inorganic fine particle A, and the method of external addition as indicated in Table 2. The properties of toners 2 to 24 and comparative toners 1 to 5 are given in Table 3. The contents of the silica fine particle and inorganic fine particle A for toners 2 to 24 and comparative toners 1 to 5 were the same as the amounts of addition during production as shown in Table 2.

TABLE 2

| Toner No. | Toner particle No. | Silica fine particle No. | Amount of addition for silica fine particle [mass parts] | Inorganic fine particle A No. | Amount of addition for inorganic fine particle A [mass parts] | External addition method |
|---|---|---|---|---|---|---|
| 1 | 1 | 1 | 2.5 | A1 | 1.2 | Henschel mixer 3600 rpm × 30 min |
| 2 | 1 | 2 | 1.8 | A1 | 1.2 | Henschel mixer 3600 rpm × 30 min |
| 3 | 1 | 3 | 4.5 | A1 | 1.2 | Henschel mixer 3600 rpm × 30 min |
| 4 | 1 | 1 | 2.0 | A1 | 1.2 | Henschel mixer 3600 rpm × 30 min |
| 5 | 1 | 1 | 3.0 | A1 | 1.2 | Henschel mixer 3600 rpm × 30 min |
| 6 | 1 | 1 | 2.5 | A2 | 1.2 | Henschel mixer 3600 rpm × 30 min |
| 7 | 1 | 1 | 2.5 | A3 | 1.2 | Henschel mixer 3600 rpm × 30 min |
| 8 | 1 | 1 | 2.5 | A4 | 1.2 | Henschel mixer 3600 rpm × 30 min |

TABLE 2-continued

| Toner No. | Toner particle No. | Silica fine particle No. | Amount of addition for silica fine particle [mass parts] | Inorganic fine particle A No. | Amount of addition for inorganic fine particle A [mass parts] | External addition method |
|---|---|---|---|---|---|---|
| 9 | 1 | 1 | 2.5 | A1 | 3.5 | Henschel mixer 3600 rpm × 30 min |
| 10 | 1 | 1 | 2.5 | A1 | 2.0 | Henschel mixer 3600 rpm × 30 min |
| 11 | 1 | 1 | 2.5 | A1 | 0.9 | Henschel mixer 3600 rpm × 30 min |
| 12 | 1 | 1 | 2.5 | A1 | 0.5 | Henschel mixer 3600 rpm × 30 min |
| 13 | 1 | 1 | 2.5 | A1 | 1.2 | 1st stage: silica fine particle 1, Henschel mixer 3600 rpm × 30 min 2nd stage: inorganic fine particle A1, Henschel mixer 3600 rpm × 10 min |
| 14 | 1 | 1 | 2.5 | A1 | 1.2 | 1st stage: inorganic fine particle A1, Henschel mixer 3600 rpm × 20 min 2nd stage: silica fine particle 1, Henschel mixer 3600 rpm × 30 min |
| 15 | 1 | 1 | 2.5 | A1 | 1.2 | 1st stage: silica fine particle 1, Henschel mixer 3600 rpm × 30 min 2nd stage: inorganic fine particle A1, Henschel mixer 3600 rpm × 5 min |
| 16 | 1 | 1 | 2.5 | A5 | 1.2 | Henschel mixer 3600 rpm × 30 min |
| 17 | 1 | 1 | 2.5 | A6 | 1.2 | Henschel mixer 3600 rpm × 30 min |
| 18 | 1 | 1 | 2.5 | A7 | 1.2 | Henschel mixer 3600 rpm × 30 min |
| 19 | 1 | 1 | 2.5 | A8 | 1.2 | Henschel mixer 3600 rpm × 30 min |
| 20 | 1 | 1 | 2.5 | A9 | 1.2 | Henschel mixer 3600 rpm × 30 min |
| 21 | 1 | 1 | 2.5 | A10 | 1.2 | Henschel mixer 3600 rpm × 30 min |
| 22 | 2 | 1 | 2.5 | A1 | 1.2 | Henschel mixer 3600 rpm × 30 min |
| 23 | 2 | 1 | 2.0 | A11 | 1.2 | Henschel mixer 3600 rpm × 30 min |
| 24 | 2 | 1 | 2.0 | A14 | 1.2 | Henschel mixer 3600 rpm × 30 min |
| Comparative 1 | 1 | 1 | 2.0 | A11 | 1.2 | Henschel mixer 3000 rpm × 15 min |
| Comparative 2 | 1 | 1 | 2.5 | A12 | 1.2 | Henschel mixer 3600 rpm × 30 min |
| Comparative 3 | 1 | 1 | 2.5 | A13 | 1.2 | Henschel mixer 3600 rpm × 30 min |
| Comparative 4 | 1 | 1 | 2.5 | A1 | 0.2 | Henschel mixer 3600 rpm × 30 min |
| Comparative 5 | 1 | 1 | 2.5 | A1 | 5.0 | Henschel mixer 3600 rpm × 30 min |

TABLE 3

| Toner No. | Particle diameter of silica fine particle [nm] | Coverage ratio X1 [area %] | Particle diameter of inorganic fine particle A [nm] | Coverage ratio X2 [area %] | Fixing ratio of inorganic fine particle A [%] | Average circularity of inorganic fine particle A | Peak at 39.700° ± 0.150° | Peak at 46.200° ± 0.150° | Sb/Sa |
|---|---|---|---|---|---|---|---|---|---|
| 1 | 12 | 80 | 35 | 12 | 65 | 0.872 | Present | Present | 2.03 |
| 2 | 6 | 77 | 35 | 12 | 65 | 0.872 | Present | Present | 2.03 |
| 3 | 45 | 76 | 35 | 12 | 65 | 0.872 | Present | Present | 2.03 |
| 4 | 12 | 62 | 35 | 12 | 65 | 0.872 | Present | Present | 2.03 |
| 5 | 12 | 93 | 35 | 5 | 65 | 0.872 | Present | Present | 2.03 |
| 6 | 12 | 72 | 15 | 25 | 70 | 0.915 | Present | Present | 1.98 |
| 7 | 12 | 81 | 47 | 9 | 59 | 0.848 | Present | Present | 2.04 |
| 8 | 12 | 82 | 58 | 8 | 54 | 0.843 | Present | Present | 2.06 |
| 9 | 12 | 60 | 35 | 35 | 52 | 0.872 | Present | Present | 2.03 |
| 10 | 12 | 76 | 35 | 20 | 65 | 0.872 | Present | Present | 2.03 |
| 11 | 12 | 80 | 35 | 9 | 65 | 0.872 | Present | Present | 2.03 |
| 12 | 12 | 80 | 35 | 5 | 72 | 0.872 | Present | Present | 2.03 |
| 13 | 12 | 80 | 35 | 12 | 40 | 0.872 | Present | Present | 2.03 |
| 14 | 12 | 80 | 35 | 12 | 99 | 0.872 | Present | Present | 2.03 |
| 15 | 12 | 80 | 35 | 12 | 38 | 0.872 | Present | Present | 2.03 |
| 16 | 12 | 80 | 32 | 12 | 65 | 0.874 | Present | Present | 1.82 |
| 17 | 12 | 80 | 37 | 12 | 63 | 0.868 | Present | Present | 2.27 |
| 18 | 12 | 80 | 38 | 12 | 63 | 0.866 | Present | Present | 1.80 |
| 19 | 12 | 80 | 42 | 12 | 64 | 0.850 | Present | Present | 2.22 |
| 20 | 12 | 80 | 42 | 12 | 63 | 0.850 | Present | Present | 2.22 |
| 21 | 12 | 80 | 42 | 12 | 64 | 0.850 | Present | Present | 2.22 |
| 22 | 12 | 80 | 35 | 10 | 64 | 0.872 | Present | Present | 2.03 |
| 23 | 12 | 61 | 39 | 6 | 63 | 0.785 | Present | Present | 2.34 |
| 24 | 12 | 60 | 58 | 6 | 64 | 0.793 | Not present | Not present | — |
| Comparative 1 | 12 | 58 | 39 | 6 | 80 | 0.785 | Present | Present | 2.34 |
| Comparative 2 | 12 | 75 | 80 | 6 | 32 | 0.937 | Present | Present | 2.19 |
| Comparative 3 | 12 | 75 | 65 | 6 | 38 | 0.833 | Present | Present | 2.19 |

TABLE 3-continued

| Toner No. | Particle diameter of silica fine particle [nm] | Coverage ratio X1 [area %] | Particle diameter of inorganic fine particle A [nm] | Coverage ratio X2 [area %] | Fixing ratio of inorganic fine particle A [%] | Average circularity of inorganic fine particle A | Peak at 39.700° ± 0.150° | Peak at 46.200° ± 0.150° | Sb/Sa |
|---|---|---|---|---|---|---|---|---|---|
| Comparative 4 | 12 | 80 | 35 | 2 | 75 | 0.872 | Present | Present | 2.03 |
| Comparative 5 | 12 | 44 | 35 | 48 | 42 | 0.872 | Present | Present | 2.03 |

In Table 3, the particle diameter of the silica fine particle is defined as the number-average particle diameter (D1) of the primary particle of the silica fine particle; the particle diameter of the inorganic fine particle A is defined as the number-average particle diameter (D1) of the primary particle of the inorganic fine particle A; and the average circularity of the inorganic fine particle A is defined as the average circularity of the primary particle of the inorganic fine particle A.

Example 1

Toner 1 was evaluated using the following evaluation methods and criteria.

A modified version of an LBP7700C (Canon Inc.) was used as the machine used for the evaluations. The cyan cartridge was refilled with toner 1, and the process speed of the main unit was modified to 350 mm/sec. In addition, assuming a downsizing of the cartridge, the diameter of the toner bearing member within the cartridge was changed to 9 mmϕ.

Evaluation of the Image Density

The evaluation of the image density was performed in a high-temperature, high-humidity environment (30° C./80% RH), which facilitates the appearance of influence from the charging stability. XEROX 4200 paper (75 g/m$^2$, Xerox Corporation) was used for the evaluation paper.

While operating in the high-temperature, high-humidity environment, and assuming this to be a rigorous long-term repetitive use test of the toner, 15,000 prints were made, in an intermittent durability test in which 2 prints were output every 5 seconds, of a horizontal line pattern image having a print percentage of 1%, and the image density was measured on the 15,000th print. To measure the image density, a 5-mm circular solid image was output, and the reflection density was measured with a Macbeth densitometer (GretagMacbeth GmbH), which is a reflection densitometer, using an SPI filter.

Here, larger numerical values indicate a better developing performance. The evaluation criteria are as follows.

Evaluation Criteria

A: the image density is at least 1.40

B: the image density is at least 1.35 and less than 1.40

C: the image density is at least 1.20 and less than 1.35

D: the image density is less than 1.20

Evaluation of Fogging

The fogging was evaluated in a low-temperature, low-humidity environment (15° C./10% RH), which facilitates the occurrence of toner charge up. XEROX 4200 paper (75 g/m$^2$, Xerox Corporation) was used for the evaluation paper.

While operating in the low-temperature, low-humidity environment, and assuming this to be a rigorous long-term repetitive use test of the toner, 15,000 prints were made, in an intermittent durability test in which 2 prints were output every 5 seconds, of a horizontal line pattern image having a print percentage of 1%.

After this, a solid white image was output and Dr-Ds was taken to be the fogging value where Ds was the worst value of the reflection density in the white background area and Dr was the average reflection density of the transfer material prior to image formation.

A reflection densitometer (Reflectometer Model TC-6DS, Tokyo Denshoku Co., Ltd.) was used to measure the reflection density of the white background area, and an amber light filter was used for the filter.

Here, a smaller numerical value indicates a better level of fogging. The evaluation criteria are as follows.

Evaluation Criteria

A: less than 1.0%

B: at least 1.0% and less than 2.0%

C: at least 2.0% and less than 3.0%

D: at least 3.0%

Evaluation of Control Defects

The control defects were evaluated in a low-temperature, low-humidity environment (15° C./10% RH), which facilitates the appearance of toner charge up and facilitates melt-adhesion by the inorganic fine particle A to the control member. XEROX 4200 paper (75 g/m$^2$, Xerox Corporation) was used as the evaluation paper.

After the 15,000 image prints had been output in the fogging evaluation, a halftone image was formed that had a toner laid-on level of 0.2 mg/cm$^2$, and the amount of speckled streaking and toner lumps seen on the image was evaluated.

Evaluation Criteria

A: no occurrence

B: speckled streaking does not occur, but small toner lumps are present at two or three locations C: some speckled streaking occurs at the ends, or four to five small toner lumps are present D: speckled streaking occurs over the entire surface, or small toner lumps are present at at least five locations, or conspicuous toner lumps are present Evaluation of the Low-Temperature Fixability The low-temperature fixability was evaluated in a low-temperature, low-humidity environment (15° C./10% RH), where toner plasticization and fixing are impeded. Using Business 4200 (weight=105 g/m$^2$, Xerox Corporation) as the evaluation paper, a halftone image having a toner laid-on level of 0.20 mg/cm$^2$ was produced and fixing was carried out with the fixation temperature being varied over the range of 150° C. to 200° C.

The resulting fixed image was rubbed five times back-and-forth with soft thin paper (tradename: Dusper, Ozu Corporation) bearing a load of 4.9 kPa; the percentage decline (%) in the image density was calculated using the formula given below; and the fixing onset temperature was taken to be the temperature at which the decline was not more than 10%. The image density was measured using a color reflection densitometer (X-RITE 404A, X-Rite, Incorporated).

Percentage density decline=(pre-rubbing image density−post-rubbing image density)×100/pre-rubbing image density Evaluation Criteria A: less than 160° C.

B: at least 160° C. and less than 165° C.

C: at least 165° C. and less than 170° C.

D: at least 170° C.

Examples 2 to 24 and Comparative Examples 1 to 5

The same evaluations as in Example 1 were performed using toners 2 to 24 and comparative toners 1 to 5. The results of the evaluations are given in Table 4.

TABLE 4

| | Toner No. | Image density evaluation | Fogging evaluation | Control defect evaluation | Low-temperature fixability evaluation |
|---|---|---|---|---|---|
| Example1 | 1 | A(1.48) | A(0.3%) | A | A(158° C.) |
| Example2 | 2 | A(1.47) | A(0.4%) | A | A(158° C.) |
| Example3 | 3 | A(1.44) | A(0.7%) | A | A(158° C.) |
| Example4 | 4 | B(1.38) | B(1.2%) | B | A(157° C.) |
| Example5 | 5 | B(1.37) | B(1.8%) | B | B(162° C.) |
| Example6 | 6 | A(1.45) | A(0.7%) | A | A(158° C.) |
| Example7 | 7 | A(1.46) | A(0.8%) | A | A(159° C.) |
| Example8 | 8 | A(1.42) | B(1.1%) | B | A(158° C.) |
| Example9 | 9 | B(1.35) | B(1.8%) | B | B(161° C.) |
| Example10 | 10 | A(1.46) | A(0.4%) | A | B(163° C.) |
| Example11 | 11 | A(1.47) | A(0.5%) | A | A(157° C.) |
| Example12 | 12 | A(1.41) | B(1.6%) | B | A(158° C.) |
| Example13 | 13 | A(1.41) | B(1.5%) | B | A(159° C.) |
| Example14 | 14 | A(1.46) | A(0.4%) | A | A(158° C.) |
| Example15 | 15 | A(1.41) | B(1.9%) | B | A(159° C.) |
| Example16 | 16 | A(1.46) | A(0.4%) | A | A(159° C.) |
| Example17 | 17 | A(1.47) | A(0.5%) | A | A(159° C.) |
| Example18 | 18 | A(1.42) | B(1.6%) | B | A(158° C.) |
| Example19 | 19 | A(1.42) | B(1.5%) | B | A(159° C.) |
| Example20 | 20 | B(1.36) | A(0.9%) | B | A(158° C.) |
| Example21 | 21 | C(1.31) | A(0.8%) | B | A(159° C.) |
| Example22 | 22 | A(1.43) | A(0.6%) | A | C(169° C.) |
| Example23 | 23 | B(1.36) | C(2.2%) | C | C(168° C.) |
| Example24 | 24 | B(1.37) | C(2.4%) | C | C(169° C.) |
| Comparative Example1 | Comparative1 | C(1.25) | D(3.2%) | D | A(159° C.) |
| Comparative Example2 | Comparative2 | C(1.28) | D(3.3%) | D | A(158° C.) |
| Comparative Example3 | Comparative3 | C(1.32) | C(2.9%) | D | A(158° C.) |
| Comparative Example4 | Comparative4 | C(1.29) | D(3.1%) | D | A(159° C.) |
| Comparative Example5 | Comparative5 | D(1.18) | D(3.1%) | D | A(159° C.) |

The present invention can provide a toner that, even during long-term continuous use in diverse use environments, produces a stable image density and can suppress the occurrence of fogging and can suppress image defects caused by control defects.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-036331, filed Feb. 28, 2017, Japanese Patent Application No. 2018-6077, filed Jan. 18, 2018, which are hereby incorporated by reference herein in their entirety.

What is claimed is:

1. A toner, comprising:

a toner particle; and an external additive comprising an inorganic fine particle A and a silica fine particle, the inorganic fine particle A being a strontium titanate fine particle having a peak at in a range of 39.700°±0.150° and a peak at in a range of 46.200°±0.150° in a CuKα x-ray diffraction spectrum obtained in a range of 2θ of from 10° to 90°, where θ is a Bragg angle, wherein in a surface of the toner observed using a scanning electron microscope (i) a number-average particle diameter of primary particle of the silica fine particle is 5 to 50 nm, and (ii) a number-average particle diameter of primary particle of the inorganic fine particle A is 10 to less than 60 nm, a coverage ratio X1 of the toner surface covered by the silica fine particle is 60 to 95 area % as determined using an x-ray photoelectron spectrometer, and a coverage ratio X2 of the toner surface covered by the inorganic fine particle A is 5 to 40 area % as determined using an x-ray photoelectron spectrometer.

2. The toner according to claim 1, wherein a fixing ratio of the inorganic fine particle A to the toner particle is from 40 to 100%, the fixing ratio being calculated by (intensity of element Sr of post water-wash toner)/(intensity of element Sr of pre water-wash toner)×100.

3. The toner according to claim 1, wherein a content of the inorganic fine particle A is 0.5 to 3.5 mass parts per 100 mass parts of the toner particle.

4. The toner according to claim 1, wherein an average circularity of primary particle of the inorganic fine particle A is from 0.700 to 0.920.

5. The toner according to claim 1, wherein a methanol concentration at a 50% transmittance of light having a wavelength of 780 nm is 60 to 95 volume % in a test of wettability of the inorganic fine particle A relative to a methanol/water mixed solvent.

6. The toner according to claim 1, wherein a number-average particle diameter of primary particle of the inorganic fine particle A in a surface of the toner is 10 to 50 nm observed using a scanning electron microscope.

7. The toner according to claim 1, wherein a Sr/Ti molar ratio for the strontium titanate fine particle is 0.70 to 0.95.

8. A toner, comprising:

a toner particle; and an external additive comprising an inorganic fine particle A and a silica fine particle, the inorganic fine particle A being a fine particle of a titanate having a Group 2 element, wherein in a surface of the toner observed using a scanning electron microscope (i) a number-average particle diameter of primary particle of the silica fine particle is 5 to 50 nm, and (ii) a number-average particle diameter of primary particle of the inorganic fine particle A is 10 to less than 60 nm, a coverage ratio X1 of the toner surface covered by the silica fine particle is 60 to 95 area % as determined using an x-ray photoelectron spectrometer, a coverage ratio X2 of the toner surface covered by the inorganic fine particle A is 5 to 40 area % as determined using an x-ray photoelectron spectrometer, and a content of the inorganic fine particle A is 0.5 to 3.5 mass parts per 100 mass parts of the toner particle.

9. A toner, comprising:

a toner particle; and an external additive comprising an inorganic fine particle A and a silica fine particle, the inorganic fine particle A being a fine particle of a titanate having a Group 2 element, wherein in a surface of the toner observed using a scanning electron microscope (i) a number-average particle diameter of primary particle of the silica fine particle is 5 to 50 nm, and (ii) a number-average particle diameter of primary particle of the inorganic fine particle A is 10 to less than 60 nm, a coverage ratio X1 of the toner surface covered by the silica fine particle is 60 to 95 area % as determined using an x-ray photoelectron spectrometer, a coverage ratio X2 of the toner surface covered by the inorganic fine particle A is 5 to 40 area % as determined using an x-ray photoelectron spectrometer, and an average circularity of primary particle of the inorganic fine particle A is from 0.700 to 0.920.

* * * * *